US007424796B2

(12) United States Patent
Shepard et al.

(10) Patent No.: US 7,424,796 B2
(45) Date of Patent: Sep. 16, 2008

(54) FILLING AND USING RECLOSABLE BAGS

(75) Inventors: William H. Shepard, Amherst, NH (US); William P. Clune, Hillsboro, NH (US); George A. Provost, Litchfield, NH (US)

(73) Assignee: Velcro Industries B.V., Curacao (AN)

( * ) Notice: Subject to any disclaimer, the term of this patent is extended or adjusted under 35 U.S.C. 154(b) by 0 days.

(21) Appl. No.: 11/927,261

(22) Filed: Oct. 29, 2007

(65) Prior Publication Data

US 2008/0041022 A1 Feb. 21, 2008

Related U.S. Application Data

(60) Division of application No. 11/180,497, filed on Jul. 12, 2005, now Pat. No. 7,308,783, which is a division of application No. 10/413,506, filed on Apr. 14, 2003, now abandoned, which is a continuation of application No. PCT/US01/31689, filed on Oct. 11, 2001.

(60) Provisional application No. 60/240,288, filed on Oct. 13, 2000.

(51) Int. Cl.
*B65B 3/16* (2006.01)

(52) U.S. Cl. ..... 53/452; 53/455; 53/456; 53/459; 53/133.4; 53/134.1; 53/329.3

(58) Field of Classification Search ..... 53/452, 53/455, 456, 459, 133.1–133.4, 134.1, 329.2, 53/329.3; 382/203, 210.1; 493/189, 190, 493/193, 197, 198, 202, 208, 209, 212, 213
See application file for complete search history.

(56) References Cited

U.S. PATENT DOCUMENTS

| | | | |
|---|---|---|---|
| 2,978,769 | A | 4/1961 | Harrah |
| 3,780,781 | A | 12/1973 | Uramoto |
| 4,169,303 | A | 10/1979 | Lemelson |
| 4,191,230 | A | 3/1980 | Ausnit |
| 4,567,987 | A | 2/1986 | Lepisto et al. |
| 4,580,683 | A | 4/1986 | Gochenour |
| 4,677,697 | A | 7/1987 | Hayes |
| 4,794,028 | A | 12/1988 | Fischer |
| 4,955,981 | A | 9/1990 | Provost |
| 5,032,122 | A | 7/1991 | Noel et al. |
| 5,088,164 | A | 2/1992 | Wilson et al. |
| 5,121,997 | A | 6/1992 | La Pierre et al. |
| 5,172,980 | A | 12/1992 | Provost |
| 5,260,015 | A | 11/1993 | Kennedy et al. |
| 5,265,960 | A | 11/1993 | Shikler |
| 5,461,845 | A | 10/1995 | Yeager |
| 5,601,368 | A | 2/1997 | Bodolay et al. |
| 5,873,456 | A | 2/1999 | Hull et al. |
| 6,115,892 | A | 9/2000 | Malin et al. |
| 6,116,314 | A | 9/2000 | Johnson |
| 6,152,601 | A | 11/2000 | Johnson |

(Continued)

FOREIGN PATENT DOCUMENTS

| | | |
|---|---|---|
| EP | 0808585 | 11/1997 |
| FR | 1578114 | 8/1969 |
| GB | 2184997 | 7/1987 |
| JP | 05-46748 | 5/1993 |
| JP | 05-46748 | 6/1993 |
| WO | WO 87/02646 | 5/1987 |
| WO | WO 00/27721 | 5/2000 |

*Primary Examiner*—Christopher Harmon
(74) *Attorney, Agent, or Firm*—Fish & Richardson P.C.

(57) ABSTRACT

A method of filling a bag that includes inserting an insulator between first and second side walls of a closure strip and joining an outer surface of the second side wall of the closure strip to an inner surface of a bag wall in a region of the wall behind which the insulator is positioned.

16 Claims, 18 Drawing Sheets

U.S. PATENT DOCUMENTS

| | | | | |
|---|---|---|---|---|
| 6,202,260 | B1 | 3/2001 | Clune et al. | |
| 6,205,623 | B1 | 3/2001 | Shepard et al. | |
| 6,244,748 | B1 | 6/2001 | Kasai et al. | |
| 6,354,738 | B1 | 3/2002 | Buckman et al. | |
| 6,378,177 | B1 | 4/2002 | Athans et al. | |
| 6,398,412 | B2 | 6/2002 | Wedi et al. | |
| 6,499,878 | B1 | 12/2002 | Dobreski et al. | |
| 6,595,690 | B2 | 7/2003 | Machacek | |
| 6,688,079 | B2 | 2/2004 | Kinigakis et al. | |
| 6,769,229 | B2 * | 8/2004 | Kinigakis et al. | ..... 53/412 |
| 6,829,873 | B2 | 12/2004 | Kinigakis et al. | |
| 6,991,372 | B2 | 1/2006 | Cornelisse | |

* cited by examiner

FILLING AND USING RECLOSABLE BAGS

CROSS-REFERENCE TO RELATED APPLICATIONS

This application is a divisional of U.S. application Ser. No. 11/180,497, filed on Jul. 12, 2005, which is a divisional of U.S. application Ser. No. 10/413,506, filed on Apr. 14, 2003, which is a continuation of and claims priority, under 35 U.S.C. §120, to PCT/US01/31689, filed Oct. 11, 2001, which claims priority to U.S. application Ser. No. 60/240,288, filed on Oct. 13, 2000, all of which are incorporated by reference.

TECHNICAL FIELD

This invention relates generally to reclosable bags having hook-and-loop closures, and to methods of filling and using such bags.

BACKGROUND

Some useful bags have reclosable closures that can form an air-tight or tamper-evident store or shelf seal, and that, after original opening, form a pantry seal, permitting convenient, repeated opening and closing of the bag.

SUMMARY OF THE INVENTION

The invention has a number of aspects that are illustrated in the following detailed description and are generally described in the claims.

According to one aspect of the invention, a reclosable bag has a folded closure strip disposed at a bag opening between opposing bag side walls and having parallel hook and loop bands extending from a surface thereof.

Preferably, the bands separated by a frangible region of the closure strip, such that the bag, after being opened by severing the frangible region, is adapted to be reclosed by folding the bag to place the hook and loop bands in releasable engagement.

In some preferred embodiments, one of the opposing bag side walls extends past the bag opening, beyond the other of the opposing bag side walls and the closure strip, to form a side wall extension.

In some cases, the side wall extension forms a funnel fitment.

The closure strip, for some applications, is joined to an inside surface of the other of the opposing bag walls, in two longitudinal, spaced apart joint regions.

In some embodiments, the closure strip is joined to an inside surface of said one of the opposing bag walls in a joint region disposed outboard of an outer edge of said other of the opposing bag walls. Preferably, the closure strip is joined to the inside surface of said one of the opposing bag walls only at its ends and in said joint region.

In some configurations, a first one of the loop band and the hook band is bordered on each side by a joint region joining the closure strip to a bag surface, and the second of said sections is bordered on only one of its sides, opposite the frangible section, by a joint region joining the closure strip to a bag surface, to define an antipeel feature.

In some instances, the loop band comprises a loop strip carried on the front face of a substrate of the closure strip and forming a discrete band of hook-engageable, extended loops along the length of the closure strip, the loop strip being at least partially encapsulated in resin of the substrate across its width. Sometimes, the loop strip has discrete regions which are more encapsulated by resin than other regions thereof.

Preferably, the hooks are integrally molded with resin of a common substrate of the closure strip.

The frangible section may comprise, for example, a region thinner than the general thickness of the closure strip, bordered on each side by formations which are thicker than the general thickness of the closure strip.

According to another aspect of the invention, a partially constructed bag is provided, suitable to be filled through an opening at its top. The bag has a closure strip disposed along its opening, the closure strip comprising a sheet-form substrate having a front face, a loop section carried on the front face of the substrate and comprising a discrete band of hook-engageable loops extending along the length of the closure strip, and a loop-engageable section of loop-engageable fastener elements extending longitudinally along the length of the closure strip and spaced apart from the section of loops. The substrate is folded in a frangible section between the loop section and the loop-engageable section, to engage the loops and fastener elements. The closure strip is permanently joined to an inside surface of one of two opposed side walls of the bag at the opening, in a joint region, leaving a fill path between the closure and the other of the opposed walls of the bag.

In some embodiments, the other of the two opposed side walls of the bag extends beyond the joint region and beyond the bag opening, forming a side wall extension on one side of the bag. The side wall extension may form a funnel fitment, or a handle, for example.

Preferably, the closure strip is joined to the inside surface in two longitudinal, spaced apart joint regions.

According to another aspect of the invention, a method of filling a bag includes providing a partially constructed bag as described above; holding the bag open to define a fill path extending past an obverse side of the closure, between the closure and the other of the opposed walls of the bag; and pouring contents into the open bag through the fill path.

In some cases, the method includes joining the obverse side of the closure to the other of the opposed walls of the bag after the bag is filled. For example, the obverse side of the closure may be joined to an extension of said other of the opposed walls of the bag by heat sealing.

In some embodiments, the other of the opposed walls of the bag extends beyond the bag opening, to form an extension. In some cases, the extension defines a handle, a support hole, or a region for mounting a header or a fitment.

In some embodiments, both walls of the bag extend beyond the closure, and an insulator is inserted between said extensions before joining said obverse side of the closure to said other of the opposed walls of the bag after the bag is filled.

The invention can enable bags, including pouches and other bag-like packaging, to be sealed adequately for storage or shipment and to have a handy touch seal closure to provide a touch seal for the bag during use of its contents. Certain preferred aspects of the invention enable filling from the top or bottom, provision for handles, headers and fitments, and inexpensive manufacture and shipment of filled bags and packaged products.

Other features and advantages will be evident to those of ordinary skill, upon review of the following description and claims.

BRIEF DESCRIPTION OF DRAWINGS

FIG. 4 is an edge view of the closure shown in FIG. 3, while

FIGS. 4B and 4C are edge and plan views of the closure applied in its flat, extended state to flat film, while

FIG. 7 is a perspective view of a completed bag which has been filled and sealed, while

FIG. 8 again is an edge view of the top of a sealed package, while

DESCRIPTION OF EMBODIMENTS

Figure 1:
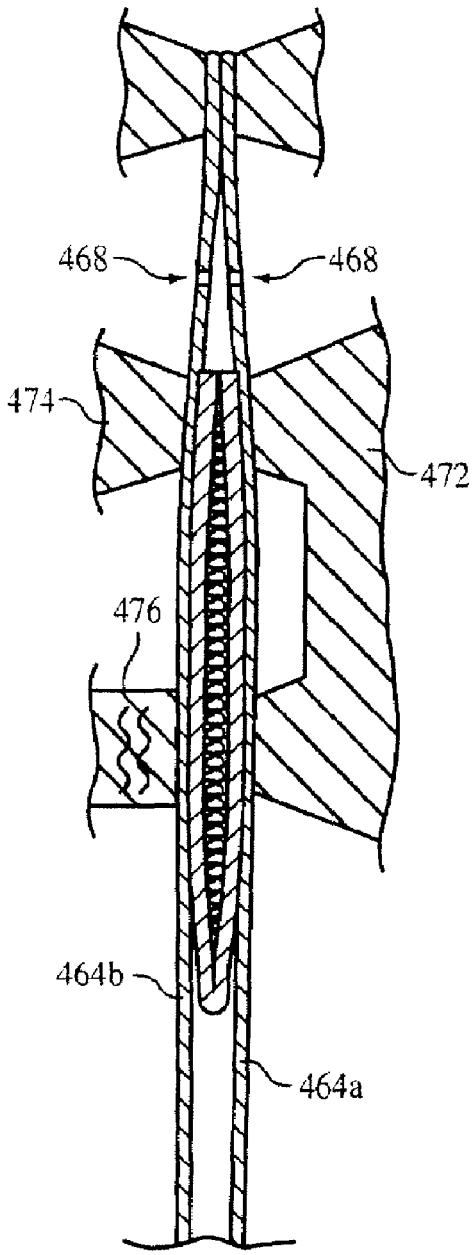
FIG. 1 is an edge cross-sectional view of a bottom filled bag showing a touch fastener with a burst-seal feature.

In important applications, an integral hook and loop bag closure unit formed on a plastic substrate is welded between front face and rear face of a bag, to close the bag at one end. FIG. 1 shows one such bag closure 462 welded to bag side sheets 464*a* and 464*b*, forming what we call an "inverted" closure. The side sheets of the bag extend upwardly beyond the closure strip and are themselves welded together to form the upper edge 466 of the bag. After the closure strip has been bonded to the bag sides, and the side edges of the bag sealed (not shown), the bag is filled from its other end, in the direction of arrow "J", which end is then sealed to close the bag. The top of the bag in this embodiment can effectively have two shelf or tamper-evident seals, a seal formed at the upper edge 466 of the bag and a seal formed by the body of closure 462.

Figure 4:
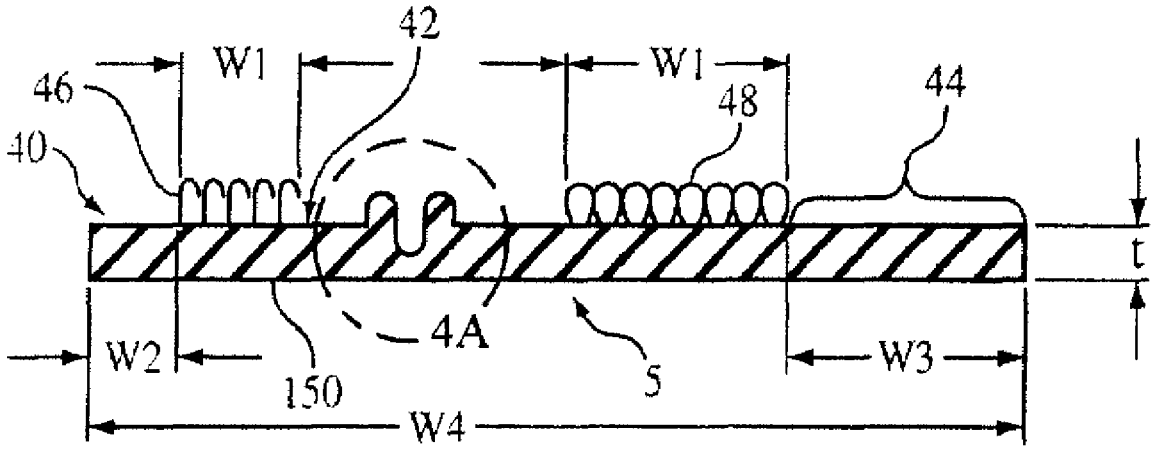

To initially open the bag, edge 466 is pulled, tearing the bag side sheets along perforations 468. Next, the closure strip is forced open and the closure strip web is pulled in two along a tear groove 470 at the closure strip fold. To reclose the bag, the loop and hook bands 104 and 106 of the closure strip are simply pressed together. One form of closure 462 has a tear feature shown in our earlier patent applications. A presently preferred form of closure is shown in FIG. 4, described below.

Figure 2:
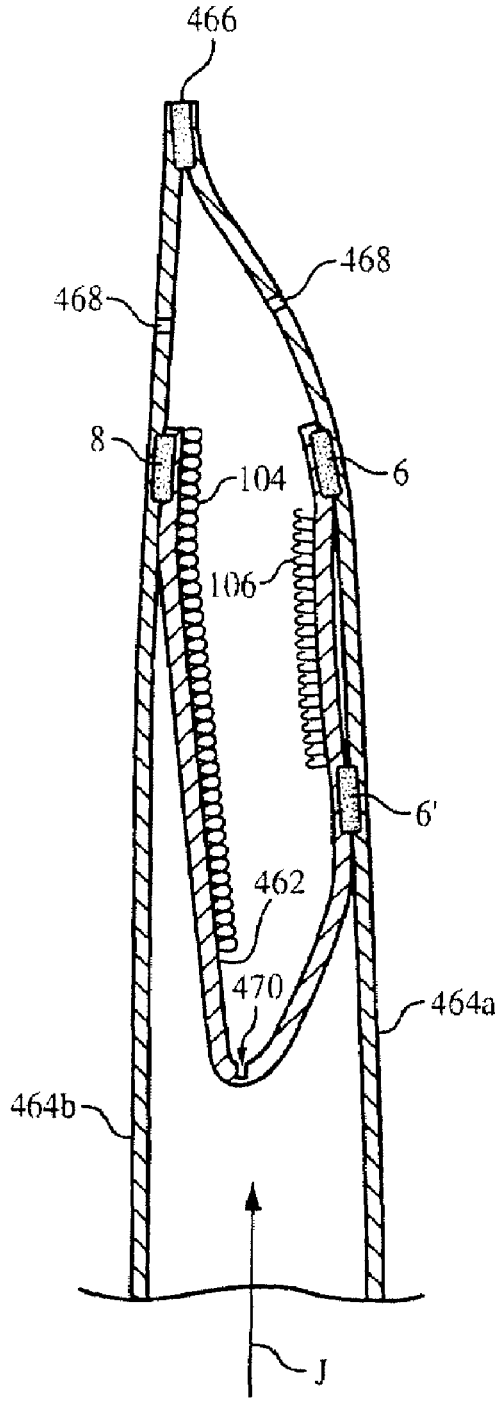
FIG. 2 is a similar view of a device forming the heat seals depicted in FIG. 1.

The welding pattern shown in FIG. 1 provides anti-peel advantages also discussed in our above-referenced patent applications, as the inner edge of the loop side of the closure strip remains unbonded to bag side sheet 464*b*. One method of forming such a weld pattern is shown in FIG. 2, in which closure strip 462 is simultaneously welded to both bag side sheets 464*a* and 464*b* by heated jaws 472 and 474, respectively. Advantageously, loop material 104 is arranged on the folded closure strip to overlap both inner and outer closure strip weld zones, inhibiting any permanent welding together of the sides of the closure strip.

In some cases, a chilled jaw 476 is pressed against the loop side of the bag adjacent the inner weld zone to further prevent undesirable bonding of the inner edge of the loop side of the closure to bag side sheet 464*b*.

Figure 3:
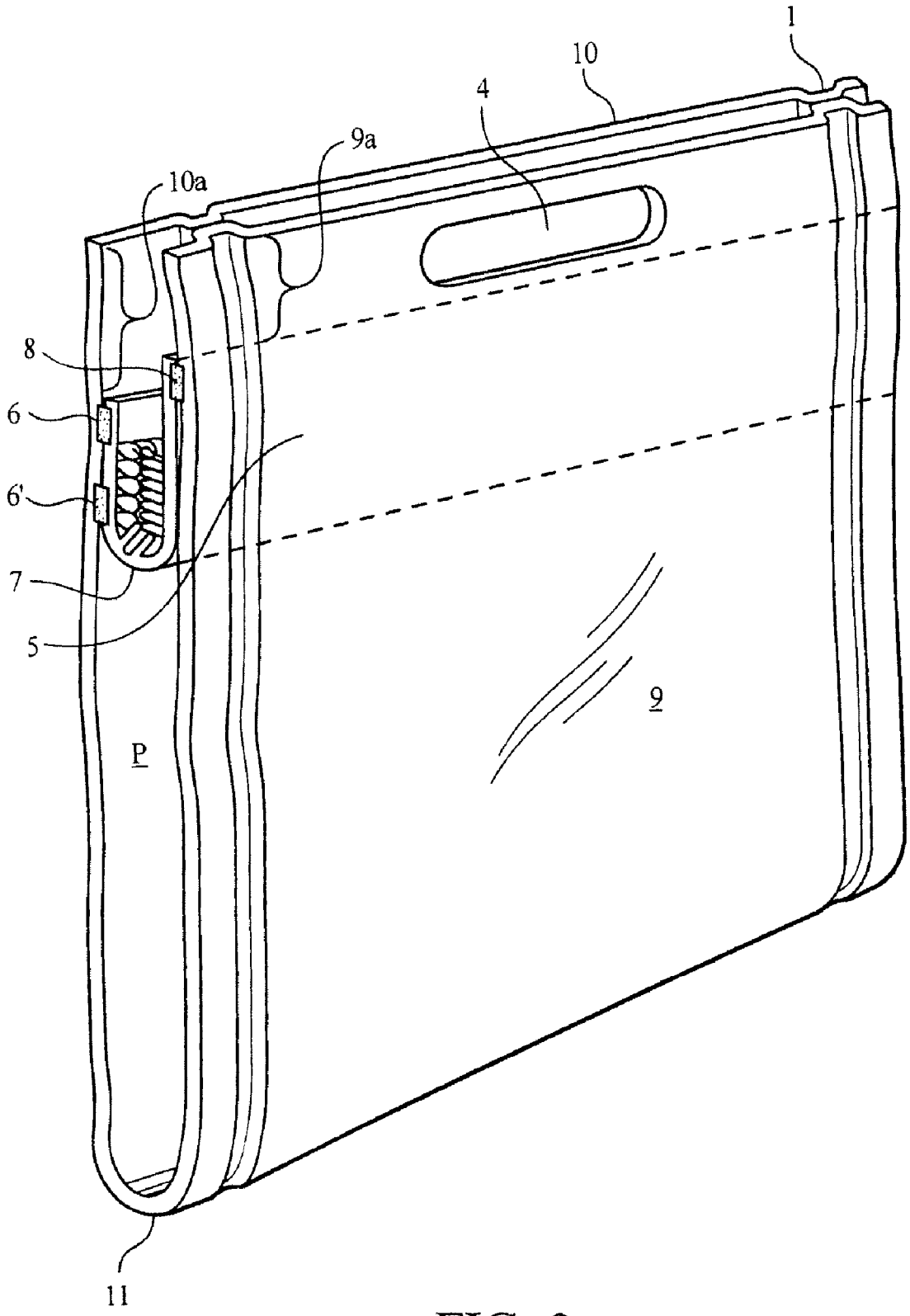
FIG. 3 is a perspective of a bag construction suitable for filling from the top.

Another embodiment, shown in FIG. 3, has only one store or shelf seal and has the important advantage for some applications of enabling filling of the bag from the top.

FIG. 3 is a perspective view of a general purpose bag. The bag is formed, in this particular example, by center-folded film having front and back walls 9, 10 folded about center-fold line 11, which extends along the bottom of the bag. The side walls are joined by closure 5 at the top of the bag. Extensions 9*a* and 10*a* of the front and back walls extend above closure 5 and have center cut-outs that form handles 4. Left and right side welds 1 run vertically from the handle end to the bottom of the bag. These side seals, together with the bottom fold, form the pocket of the bag.

In manufacture, the film from which the bag is made can be brought into the bag-forming station either folded or flat. For instance, center-folded film may be brought into, e.g., a horizontal bag-making machine, in which the center-folded film is oriented horizontally through the machine, and is indexed relative to weld equipment such that the side welds 1 are separated by a selected index distance. For the forming of a side weld 1, in the usual manner, a seal jaw comes down on regions 1, forming not only the seal but also typically a cut that separates the bag being formed from the next adjacent bag. Alternatively the cut can be made after the seal at another station, also in a usual manner.

In the bag of FIG. 3, in the region B at side seal 1, a side extension of the film overhangs the seal 1 laterally, and a cut is made downstream to separate the bag. Alternatively, a conventional band seal may be formed, on which cut-off occurs at the time of sealing, so that there is no overhang. In another alternative, a conventional bead seal is formed (e.g., by a hot-wire or a hot knife), which simultaneously cuts and seals together the two faces of the bag, this latter technique being very quick, permitting rapid production of relatively inexpensive bags.

As previously explained, FIG. 3 shows a center-folded film. Alternatively, the bag may be formed of two separate sheets of film, in place of center-folded film, which are welded across the bottom in place of a center fold. A pleated or gusseted bottom may also be used in lieu of the center fold. These and other conventional bag constructions can be employed, with or without the handles 4 and with various other top, side and bottom constructions.

Figure 4A:
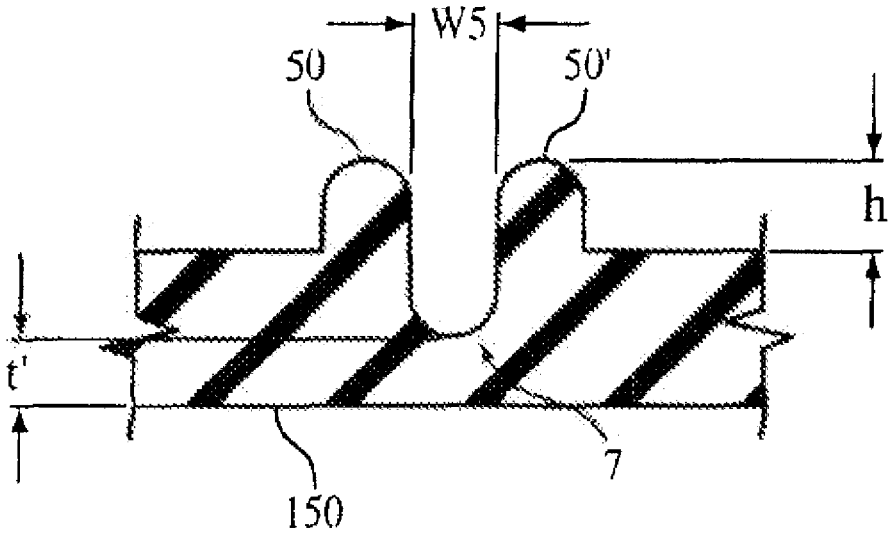
FIG. 4A is a magnified edge view of area 4A of FIG. 4.

We refer now to FIGS. 4 and 4A, which show a composite membrane-touch closure that provides a re-close feature for the bag. It is preferably formed according to the techniques explained in our earlier patent applications, incorporated by reference below. Several features enable its attachment and allow the outer closure to hold back product that is loaded against the closure. Weld flange 44 of width $W_3$ provides the region at which the final weld is formed after the bag has been filled. This is the only weld region on this side of the closure and provides an anti-peel action for the closure. As shown in FIG. 4, outer weld flange 44 is associated with a loop section 48 of the closure unit. Hook section 46, associated with the other side of the closure unit, is bordered by inner- and outer-weld regions 40 and 42. Between these closure sections is burst section 7. Whereas the base 150 of the closure generally has thickness t in the region of the weld flanges 40, 40' and 44 and of the hook and loop sections 46 and 48, the thickness of the failure region of the burst section, t', is substantially thinner than t. For example, t may be 0.005 inch (0.13 millimeter) and t' 0.002 to 0.003 inch (0.05 or 0.08 millimeter). The hook and loop bands each have a width $W_1$ of about 19 millimeters. One weld flange has a width $W_2$ of about 9.5 millimeters, while the other has a width $W_3$ of about 16 millimeters. The overall width $W_4$ of the closure strip is about 7.8 centimeters.

Burst rails 50 and 50', shown in detail in FIG. 4A, are reinforcement rails, thicker than t, which assure that the burst or desired rupture of the film, when it occurs, occurs at thickness t, in a discrete direction, and does not propagate beyond into either the hook or loop regions. The frangible region between the rails has a width $W_5$ of about 0.030 inch (0.75 millimeter), and rails 50 and 50' extend above the substrate a height "h" of about 0.030 inch (0.75 millimeter).

In some instances, loop material 104 is partially encapsulated directly in resin of the substrate as the substrate is formed in a continuous molding process (described below). In other cases, it is bonded to the formed substrate, either by ultrasonic bonding, welding, or adhesives.

Figure 13A:
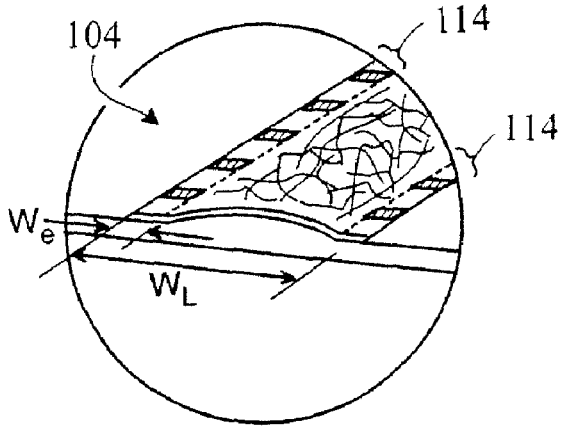
FIGS. 13A through 13G illustrate the structure of embodiments of a loop strip.

FIGS. 13A through 13D illustrate various patterns of variable bonding between loop material 104 and substrate 102. Such variable bonding patterns correspond, in some cases, to variable resin penetration into the web of the loop material, which may be achieved by employing different arrangements of staking rings and/or barrier materials between the loop material and substrate, both of which are discussed further below. In FIG. 13A, loop material 104 is only fully penetrated by substrate resin in narrow edge regions 114, and is less penetrated at its center. For instance, if loop material is about ¾ inch wide (WL), then fully penetrated edge regions 114 may have a width of only about ⅛ inch (we). The center region of the loop material is less penetrated and gently arches away from the substrate, presenting the loops for engagement. The inclined sides of the center arch can also help to enhance the peel strength of the fastening at the edges of the loop material, as they resolve a small component of the peel force in a tangential, or shear, direction.

Figure 13B:
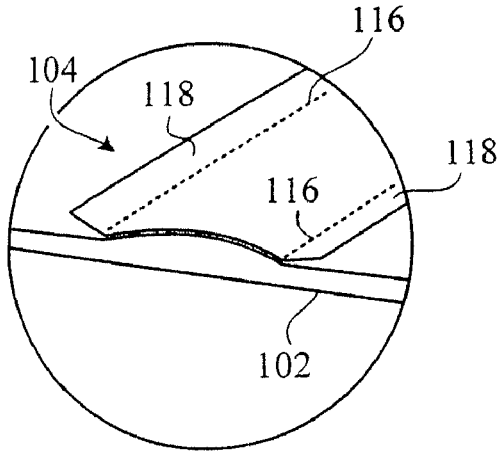

In FIG. 13B, the loop material is fully bonded to the substrate in narrow bands 116 spaced inward from its edges, leaving edge regions 118 relatively lightly bonded, or even loose. One advantage of this bonding pattern is that the inner edge region 118 on the inside of the associated bag helps to deflect separation loads caused by shifting bag contents, which would otherwise generate high peel forces between the fastener elements and the loops, into separation forces between the loop material and substrate. The high bonding strength of inner band 118 helps to avoid delamination of the loop material from the substrate. Another advantage of this bonding pattern is that it enhances initial peel strength of the fastening, as the outer edge region 118 of the loop material follows the fastener elements during peel until it is separated in shear.

Figure 13C:
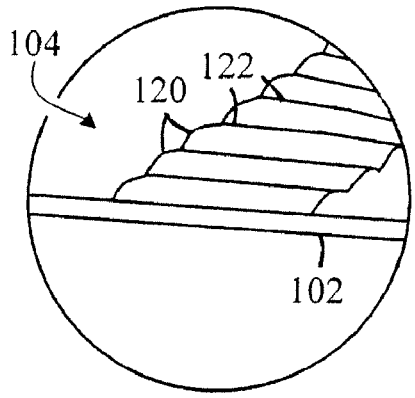

The pattern of variable bonding shown in FIG. 13C creates transverse pillows 120 of relatively lightly bonded, or loose, loop material separated by transverse bands 122 of relatively more fully bonded (e.g., more deeply encapsulated) loop material. The loftiness of pillows 120 is exaggerated for illustration. This pattern provides some of the peel-enhancing and load-shifting advantages of the pattern of FIG. 13B, due to the "free" pillow ends along the inner and outer edges of the loop material.

Figure 13D:
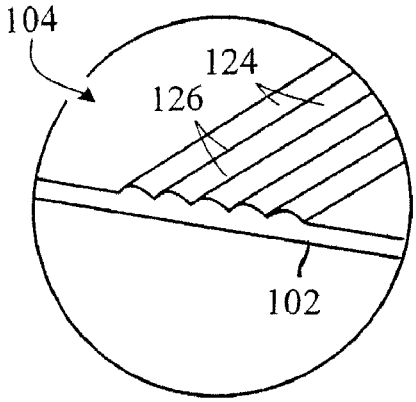
Figure 13E:
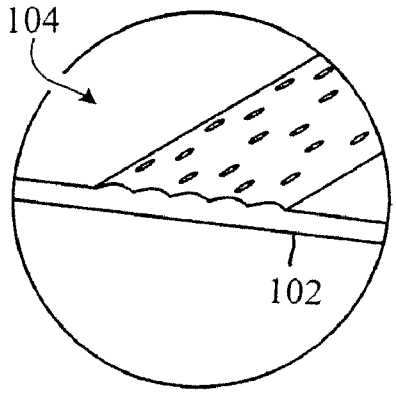
Figure 13F:
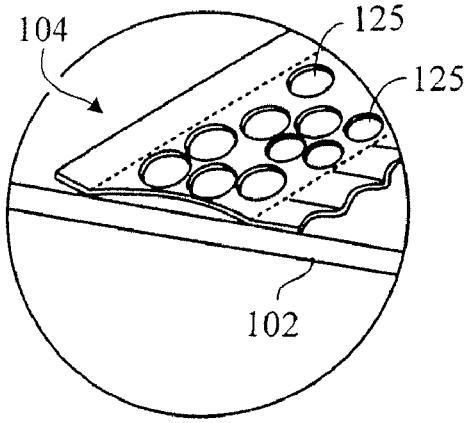
Figure 13G:
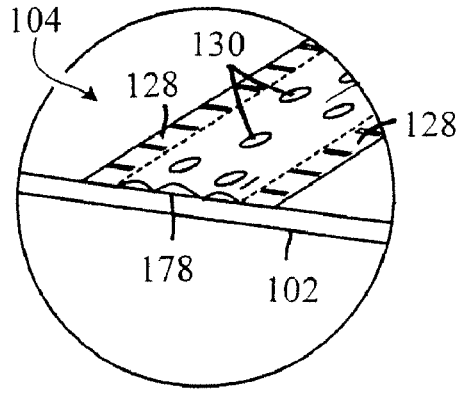

FIG. 13D illustrates a bonding pattern with longitudinal pillows 124 of relatively lightly bonded, or loose, loop material, separated by longitudinal bands 126 of relatively more fully bonded (e.g., more deeply encapsulated) loop material. Again, the loftiness of the pillows is exaggerated for illustration. FIG. 13E is a variation of the pattern of FIG. 13D, with each longitudinal band of more fully bonded material separated into longitudinally alternating regions of light and heavy bonding. The regions of light and heavy bonding are staggered across the loop material, producing a checkerboard pattern of lofted loop pillows. In the pattern illustrated in FIG. 13F, the center region of loop material 104 is heavily bonded to the substrate about the peripheries of spaced apart, circular lofted regions 125 which are less firmly bonded. The exposed surfaces of the lofted loop pillows 125 extend outward to present loops for engagement. Other shapes of lofted regions 125, such as ovals, may also be employed. One of the edge regions of the loop material of FIG. 13F is similar to the edge regions shown in FIG. 13B, while the other forms transverse pillows similar to those of FIG. 13C. FIG. 13G shows a bonding pattern with edge regions 128 of alternating light and heavy bonding, and a center region bonded in only isolated regions 130. The bonding patterns described above may be mixed and varied for different applications, as required.

Figure 14:
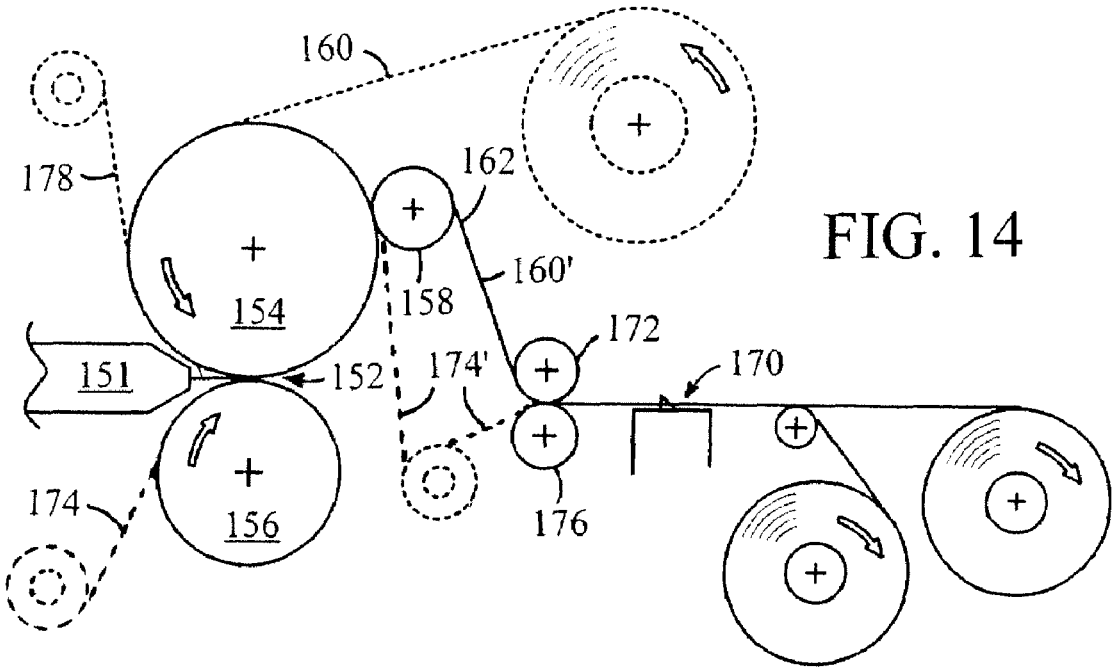
FIG. 14 illustrates a method and apparatus for forming composite closure strips.

FIG. 14 illustrates one method and apparatus for producing the above-described closure strips. The method builds upon the continuous extrusion/roll-forming method for molding fastener elements on an integral, sheet-form base described by Fischer in U.S. Pat. No. 4,794,028, and the nip lamination process described by Kennedy, et al. in U.S. Pat. No. 5,260,015. The relative position and size of the rolls and other components is not to scale. An extrusion head 151 supplies a continuous sheet of molten resin to a nip 152 between a rotating mold roll 154 and a counter-rotating pressure roll 156. Mold roll 154 contains an array of miniature, fastener element-shaped mold cavities extending inward from its periphery (not shown) for molding the fastener elements. Pressure in nip 152 forces resin into the fastener element cavities and forms the substrate. The formed product is cooled on the mold roll until the solidified fastener elements (e.g., hooks) are stripped from their fixed cavities by a stripper roll 158. Along with the molten resin, a continuous strip of loop material 160 (which becomes loop band 104 in FIG. 2) is fed into nip 152, where it is partially impregnated by resin and becomes permanently bonded to the front face of the substrate. Thus the product 162 which is stripped from the mold roll includes both fastener elements and loops.

Figure 15:
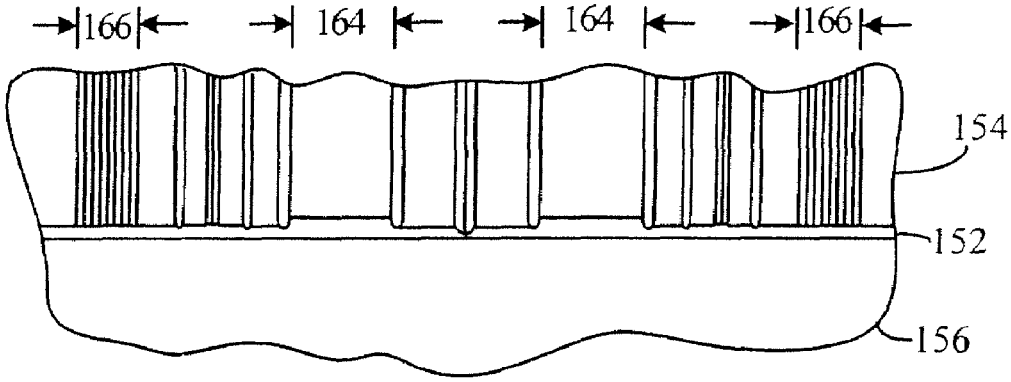
FIG. 15 is an enlarged, unscaled view of the forming nip of the apparatus of FIG. 14.

For higher production rates, two or more widths of closure strip may be simultaneously produced on a single mold roll, and later split and spooled. Referring also to FIG. 15, two strips 160 of loop product are fed in parallel into positions 164 along nip 152. Molten resin is introduced across the entire nip, forming two bands of hooks in regions 166. Mold roll plates of appropriate widths and edge configurations are arranged to produce the ribs and grooves at the center of each closure strip. A splitting channel ring 168 at the center of the mold roll produces a splitting channel in the product, along which the resulting tape is split by a blade 170 (FIG. 14; either stationary or rotating) into two separate runs of closure strip which are separately spooled.

FIG. 14 also indicates several variations of the above-described method. For instance, rather than introduce the loop material 160 through nip 152 and thereby join it to the substrate as the substrate is molded, the loop material may be joined to the substrate after the substrate has been formed, such as is indicated by the run 160' of loop material shown in dashed outline. In this case, front face idler 172 is heated and has a contoured surface for producing the desired pattern of bonding between the loop material and the substrate. Paper may be joined to the back face of the substrate by either running a strip 174 of paper through nip 152 on the pressure roll side of the resin, or by adhering adhesive-coated paper 174' to the formed substrate either at stripping roll 158 or at idler 176. In some cases, adhesive-coated paper 174' includes a transfer coating, such that its paper backing may be peeled from the adhesive on the back of the product to secure the back of the final product to a supporting surface. The adhesive applied to the back of the product in this manner may be either a pressure-sensitive or heat-activated adhesive, for instance. For decreasing the permeability of the final product, a second flow of resin (either molten or in the form of a film) may be added to the nip against pressure roll 156, as strip 174 is shown, to form a backing on the final product. For instance, a layer of polyester may be added to reduce the permeability of a polyethylene closure strip, such as for packaging certain foods. The pattern of penetration of resin into the loop material in nip 152 is optionally controlled by adding a strip of barrier material 178 between the loop material and the molten resin. Barrier material 178 may be, for instance, a perforated paper or film that allows resin to pass into the loop material in selected regions but inhibits its flow into other regions, such as for producing the bonding pattern of the center region of loop material shown in FIG. 13G. The barrier material may also be a homogeneous sheet of material having a high porosity, equally limiting the penetration of resin into the loop material across the width of the barrier material. Rather than be introduced as a separate sheet, the barrier material may be pre-applied to the surface of loop material 160 and may be in the form of a binder located in discrete areas of the loop material and locally encapsulating fibers of the loop material, for instance. In many cases, the barrier material will be narrower than the loop material, and centered along the width of the loop material, to enable full penetration of resin into the edges of the loop material. In some cases, however, as to produce the bonding pattern of FIG. 13B, for instance, thin strips of barrier material may be run into the nip along the edges of the loop material to inhibit the bonding of edge regions 118 (FIG. 13B) to the substrate. Other arrangements of barrier and loop materials, and resulting bonding patterns, will be apparent upon reading this disclosure. In all cases, the barrier material should be selected for its low material cost and weight, as it will most likely be permanently bonded to the substrate and become an integral part of the final product.

Figure 16:
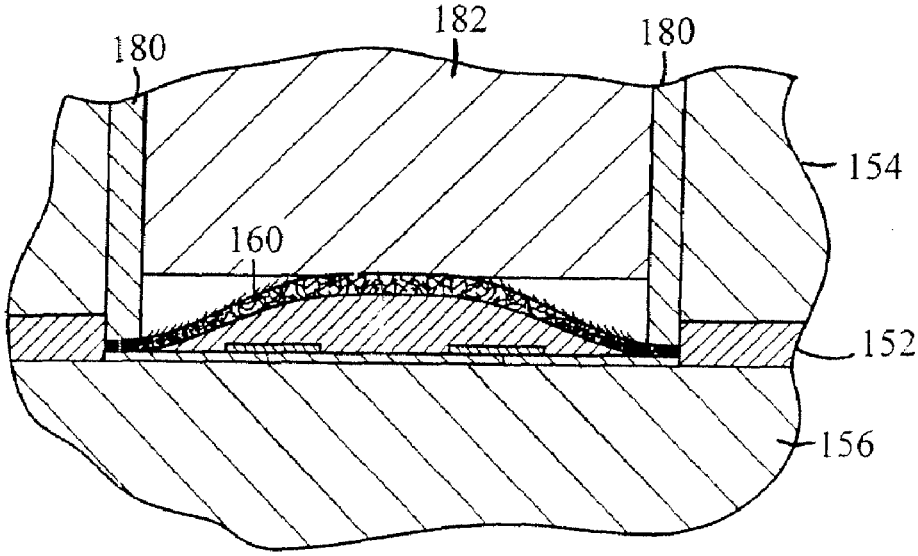
FIG. 16 is a highly enlarged view of the loop material securing region of the nip of FIG. 14.

FIG. 16 illustrates the bonding of the loop material 160 to the resin of the substrate in area 164 of nip 152 (FIG. 15). "Staking" rings 180 on either side of a reduced diameter plate 182 engage the edges of the loop material to locally hold the edges of the loop material against the resin of the substrate as the resin forms the substrate under nip pressure, thereby ensuring heavy penetration of the loop material in predetermined areas along its edges. This configuration shown in FIG. 16 produces the bonding pattern illustrated in FIG. 13A, the staking rings 180 forming heavily bonded edge regions 114, the width we corresponding to the width of the staking ring. The staking rings may extend slightly beyond the nominal mold roll diameter, as shown in FIG. 16, or be flush with adjoining mold roll rings (as shown in FIG. 16A, for example).

Figure 17:
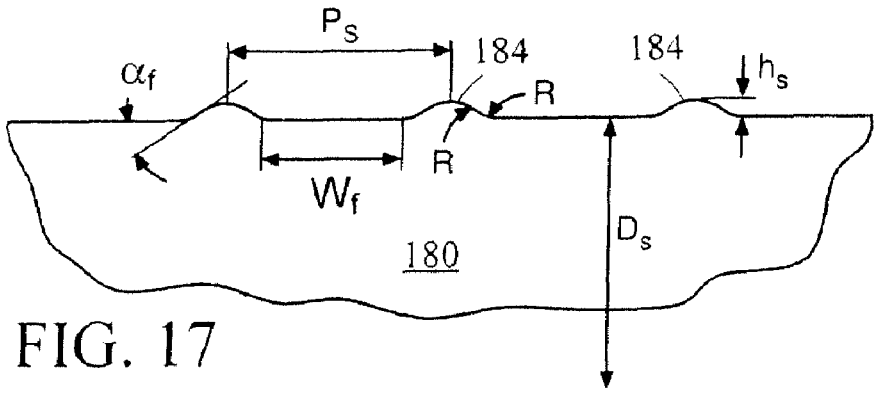
FIG. 17 is an enlarged view of a portion of the outer edge of a staking ring.

To form a row of heavily bonded points separated by regions of lower resin penetration, some staking rings 180 have a contoured outer edge as shown in FIG. 17. A series of protrusions 184 extending beyond the nominal diameter $D_s$ of the staking ring cause the resin to locally penetrate farther into the loop material. In this example configuration, $D_s$ is 9.968 inches, the height ($h_s$) of each protrusion 184 is 0.014 inch, and the inner and outer radii (R) at the flank of each protrusion is 0.015 inch. The protrusion pitch (Ps) is 0.190 inch, and the length of the flat between protrusions ($w_f$) is 0.130 inch. The dimensions of the protrusions are selected to attempt to optimize the maximum approach angle $\alpha_f$ of the protrusion flank with respect to a local ring tangent. A steep approach angle (i.e., an abrupt change in ring diameter) can cause a sharp local increase in nip pressure and an undesirable local flooding of the front side of the loop material with resin. Such flooded areas can create local "depth stops" to mating fastener elements, reducing the fastener element penetration into the loop material. A zero approach angle (i.e., no protrusions) would result in a homogeneous resin penetration beneath the staking ring, which may not be as desirable as local loop material "pillowing" (discussed above) in some applications. The maximum approach angle $\alpha_f$ in the illustrated staking ring embodiment is about 40 degrees. A shallower angle (e.g., of about 30 degrees) may be preferable in some cases, as may a longer spacing $w_f$ between protrusions to provide longer, lofted pillow regions.

Figure 16A:
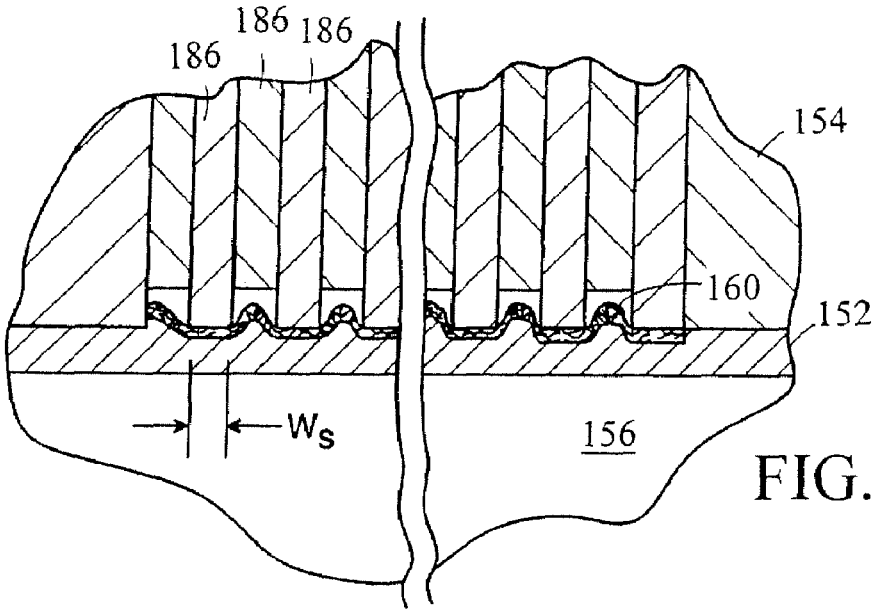
FIG. 16A illustrates an alternative arrangement of the loop material staking region.

FIG. 16A shows a staking ring configuration for producing the bonding pattern shown in FIG. 13E. Staking rings 186 having the profile shown in FIG. 17 are stacked together with staggered protrusions, such that the pattern of heavily bonded regions resembles a checkerboard with elongated "pillows" extending outward between the heavily bonded regions. The width $w_s$ of each ring is about 0.018 inch.

Figure 18:
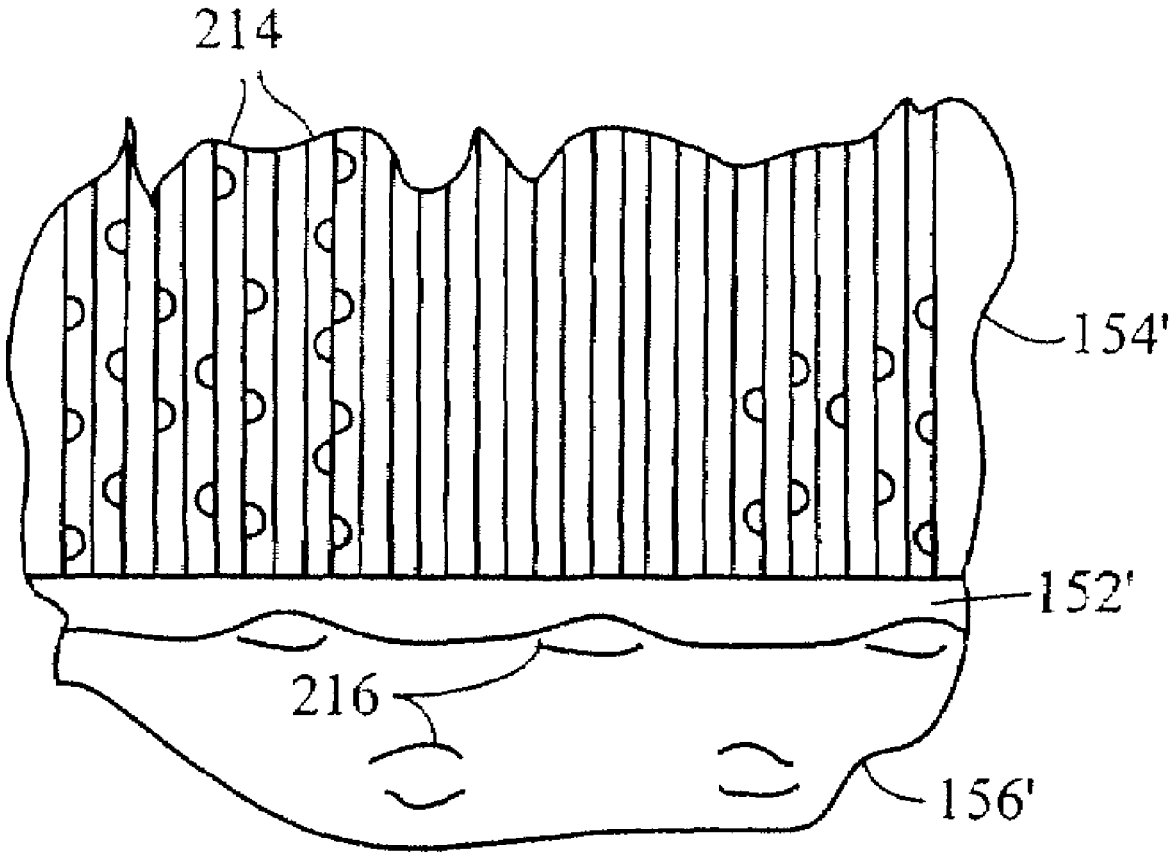
FIG. 18 shows a nip formed between a mold roll and a contoured pressure roll.

This in situ staking method for attaching loop material to the resin of a fastener substrate as the substrate is being formed has broad applicability to the production of composite touch fasteners. For example, FIG. 18 shows a nip 152' between a mold roll 154' and a pressure roll 156'. Mold roll 154' contains many thin fastener element molding rings 214, which may be alternated with spacer rings (not shown), to integrally mold fastener elements extending from one side of a sheet-form base as taught by Fischer. In this case, however, pressure roll 156' has a pattern of protrusions 216 extending from its otherwise smooth surface. The protrusions locally narrow gap 152' in discrete regions, causing a variation in nip pressure during formation of the fastener tape. Running a fibrous preformed material through the nip against the pressure roll with the molten resin, as taught by Kennedy, et al., will, in this configuration, cause fibers of the preformed material to be encapsulated more fully in the resin in areas corresponding to protrusions 216. This in situ "staking" method is particularly useful when the fibrous preformed material is a very porous, thin material such as a needled non-woven web with a low basis weight. The pattern of protrusions on the pressure roll is selected to form an inverse pattern of lofted "pillows" of loop material at most only partially encapsulated in the substrate resin.

Figure 3B:
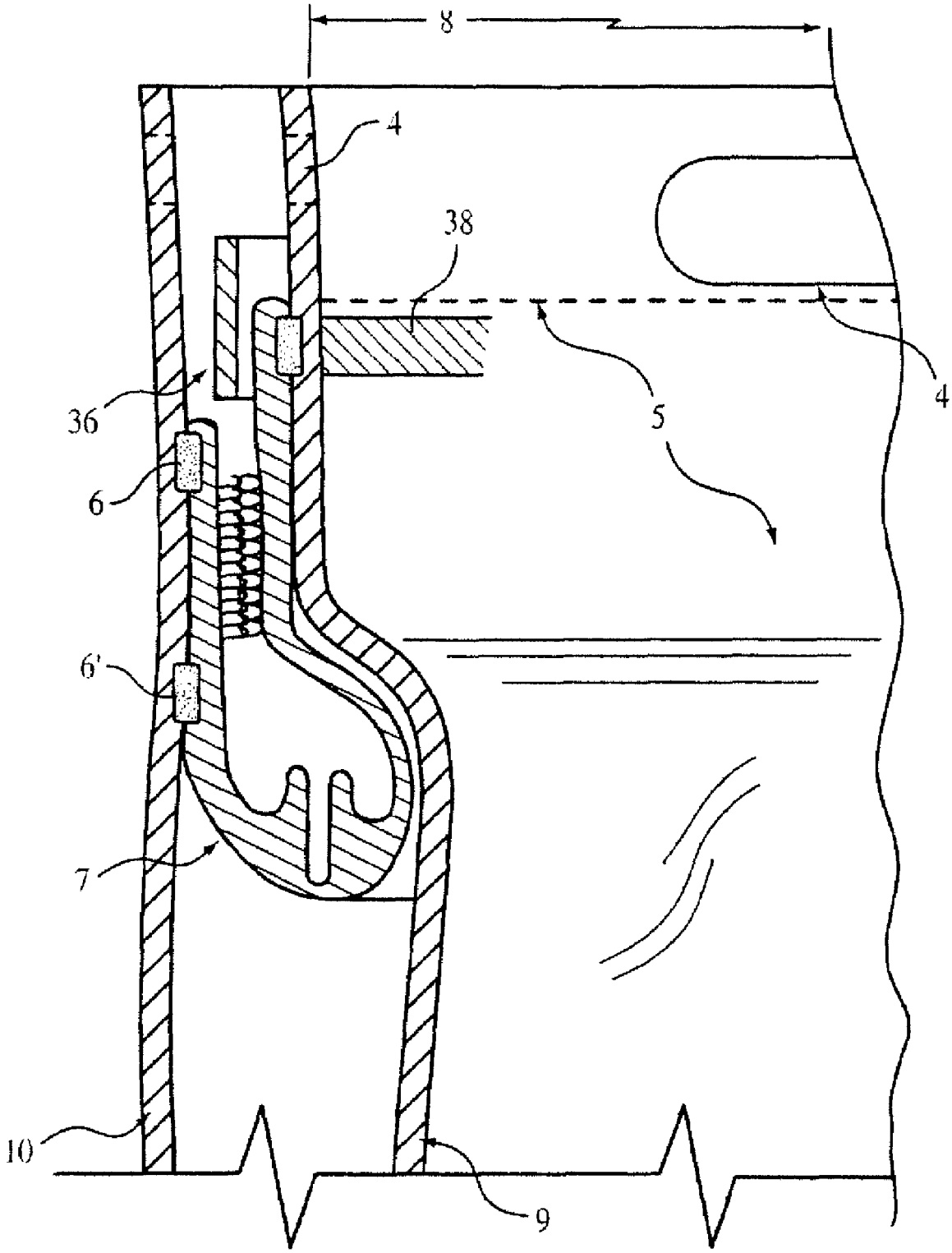
FIG. 3B shows an example of a technique for forming the final seal of the bag of FIG. 3.
Figure 4B:
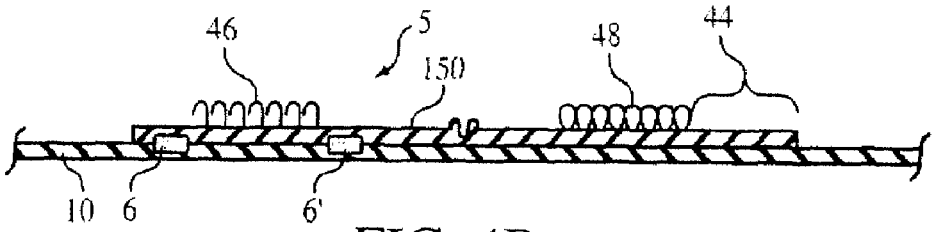
Figure 4C:
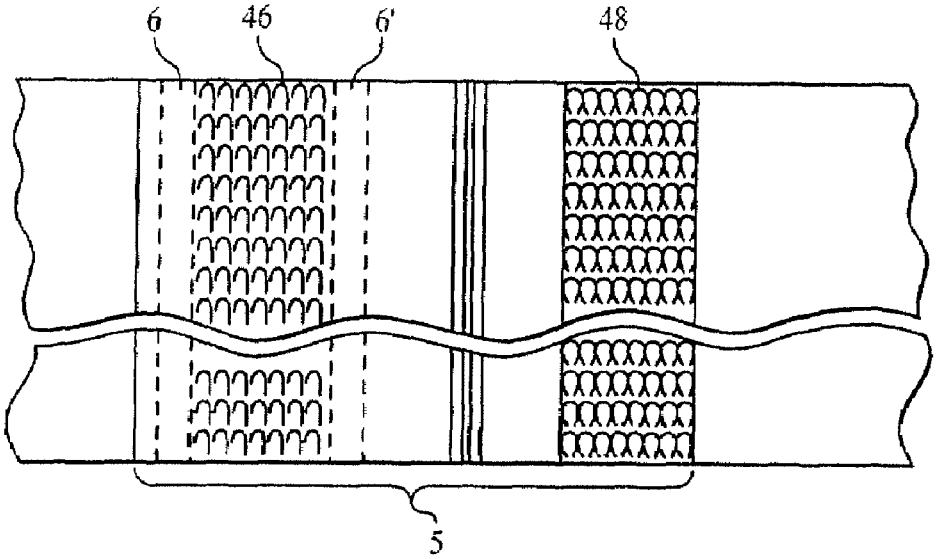

The closure 5 typically is welded to bag film as shown in FIG. 3. The first seal areas 6 and 6' are formed to the back wall 10 at opposite sides of the hook section, at weld flanges or regions 40 and 42 of FIG. 4. This provides joint regions. These welds may be applied while the film is flat, before center-folding. The welds 6 and 6' can be made either one right after another, or, as with a conventional drag sealer on a horizontal bag maker, both the upper and lower seals 6 and 6' may be formed at the same time. The seal jaws in FIG. 3B are custom-machined to have an undercut in the region of the hook section to protect the hooks, while portions of the weld shoe are in position for the upper weld 6 and the lower weld 6'. At the stage illustrated in FIGS. 4B and 4C, neither the closure unit nor the bag film have been folded.

Figure 4D:
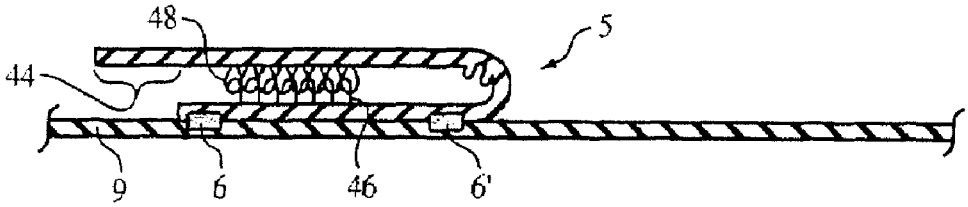
FIGS. 4D and 4E are similar views of the film showing the closure folded and mated.
Figure 4E:
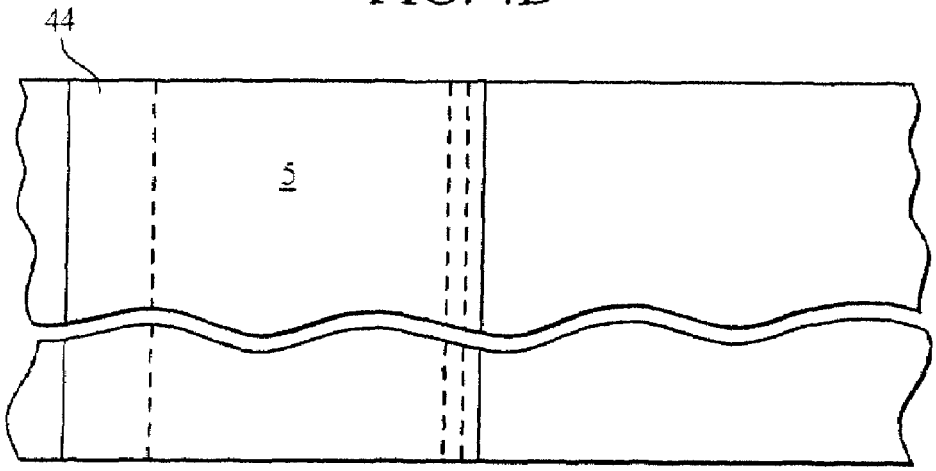

The edge and plan views, FIGS. 4D and 4E, show the closure now folded, e.g., by a folding shoe, about the burst feature 7 of FIG. 4A, with hooks 46 engaged with the loops 48. The film is now center-folded, ready to be formed into the bag of FIG. 3; however, at the stage being described, final seal 8 has not been formed (it is formed after the bag is filled, as will later be described).

Referring further to FIG. 3, the assembly of the closure on the bag is shown with the burst feature 7 of the closure oriented toward the product side P of the bag. The cut-outs for forming the handle 4 typically are die-cut just prior to the time the left and right seals 1 are made. This is an optional feature. With the bag construction shown, the burst seal is configured to provide the shelf seal of the package, such that there is no need for an additional seal located above the closure 5. In other cases, the two hand sections can be tack-welded at spaced points, the welds rupturable by opening movements of the handles, or can be joined by pressure-sensitive adhesive or peelable cohesive seals, which also are separable by opening movement of the handles.

It is to be noted from FIG. 3 that the final seal 8 on the front wall of the bag is located above top seal 6 on the back wall. This provides joint regions. As will be later explained in more detail, this construction permits the bag to be filled (see FIG. 3A), after which an insulator can enter through the opening of the bag, as shown in FIG. 3B, to provide insulation behind the closure at the time of heat-forming seal 8, so that the entire bag need not be welded shut in this region. In other words, side 10 and side 9 are not sealed together when seal 8 is formed. FIG. 3B shows insulator bar 36 located behind the closure 5 so that, when heated seal jaw 38 is initiated to make the seal between the bag film 9 and the closure flange 44 of FIG. 4, bag wall 10 is not included in the seal.

In an alternative construction, an anti-thermal bonding coating or treatment is applied to one or both of the contacting surfaces to prevent unwanted thermal sealing of the contacting surfaces, and the insulator may be omitted.

In an alternate construction, the insulator is not employed, and a "sandwich" seal of layers 9, 44 and 10 is formed, and a tear region is provided in the upper extension at wall 9 between that and weld 6.

Other types of bag construction can of course be employed with the closure described.

Figure 3A:
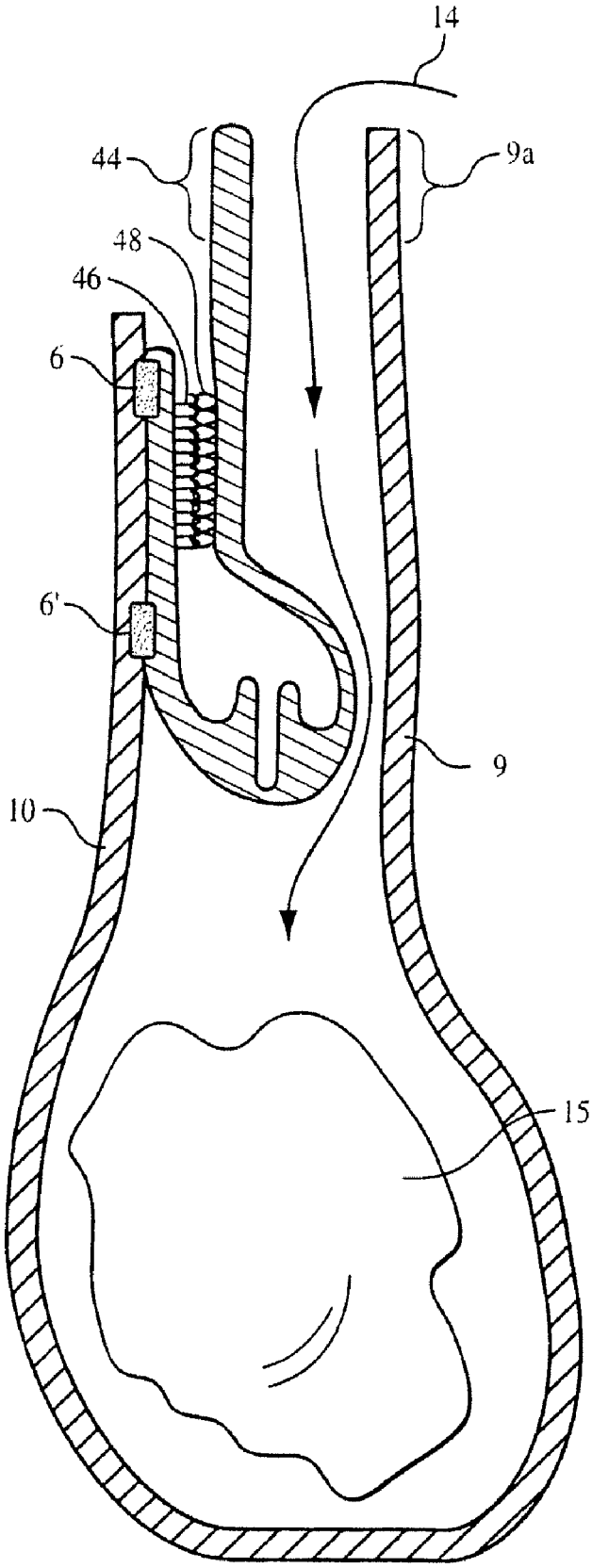
FIG. 3A is an edge view illustrating the fill path for a bag using the closure of FIG. 4 prior to forming the final seal.

Referring now to FIG. 3A, in a preferred use of the closure of FIG. 4, at the time of filling the bag, the hook and loop sections 46, 48 are mated or engaged, so that prior to final weld 8, the loop section 48 of the closure is held next to the back wall 10 of the bag, spaced from the front wall 9, to provide for fill path 14 past the obverse or back side of the center-folded closure. Thus, product can be introduced into the bag (see also FIG. 3B) after which weld-flange region 44 of the closure is welded to the mating portion 9*a* of the front wall. This provides joint regions. This final weld may be applied automatically, as shown, or by hand using an impulse sealer.

FIGS. 5A through 5G illustrate an automatic method to open and fill a bag such as produced according to FIG. 3. These are sectional views as in FIG. 3E.

Figure 5D:
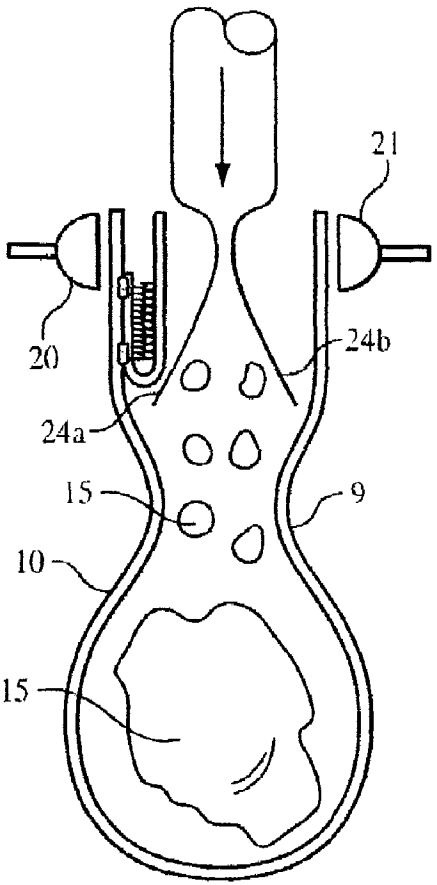
FIGS. 5A through 5G illustrate a sequence of steps for filling the bag.
Figure 5C:
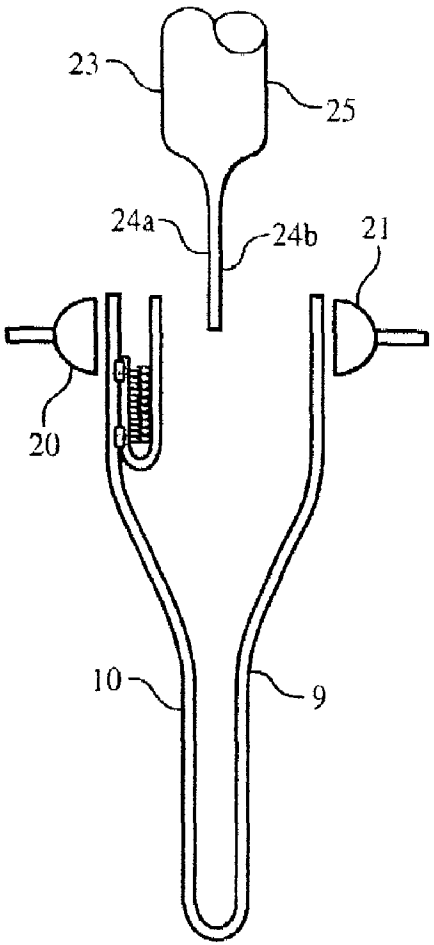
Figure 5B:
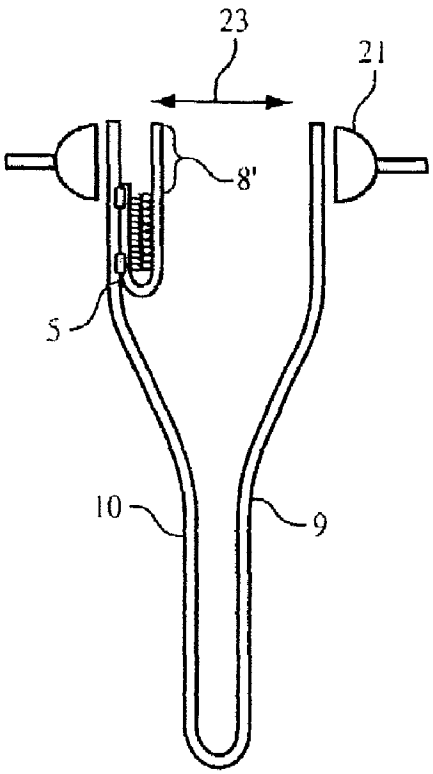
Figure 5A:
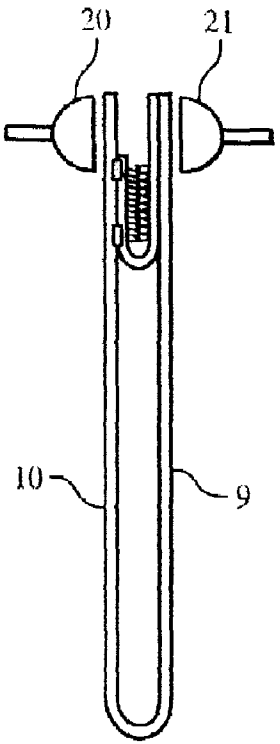

In FIG. 5A, suction cups 20 and 21 are engaged with the upper area of the film walls 9 and 10 at the front and back sides of the bag. FIG. 5B shows the suction cups to have opened in the direction of arrow 23. In other words, the suction cups have now moved away from each other to a fixed dimension, opening the top of the bag. In the configuration of FIG. 5B, because the final seal 8 has not been made at the obverse side 8' of the closure strip, essentially no force is required for opening the bag beyond the flexing resistance of the bag film, making the bag or pouch easy and very reliable to open.

FIG. 5C shows suction cups 20 and 21 remaining fully extended, and a filling funnel 24 is shown entering the open bag in the direction of arrow 25. In this illustration, the filling funnel has at its lower end a pair of so-called "duck bill" funnel elements 24*a*, 24*b*. While such a duckbill device is one of the more popular ways to fill bags and pouches, the invention is of course not limited to that technique. Even a simple funnel can be employed. In FIG. 5D, the duckbill funnel has entered to its full insertion depth past the opening of the bag, and the duckbill elements are shown extended apart at a position lower than the suction cups and upper portions of the open bag. The center-folded closure presents its back to the product filling the bag. Thus, as previously noted, the closure is protected from contamination that might interfere with its eventual function or appearance. In FIG. 5D, product is shown starting to fill the bag. The spread-open left and right duckbill elements 24*a*, 24*b* hold the bag open and define the flow path for the product.

Figure 5G:
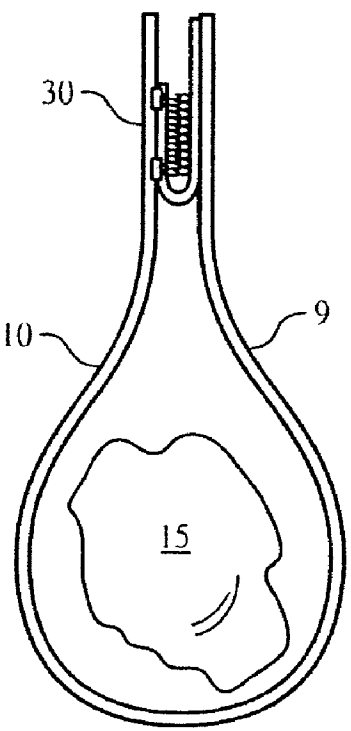
Figure 5F:
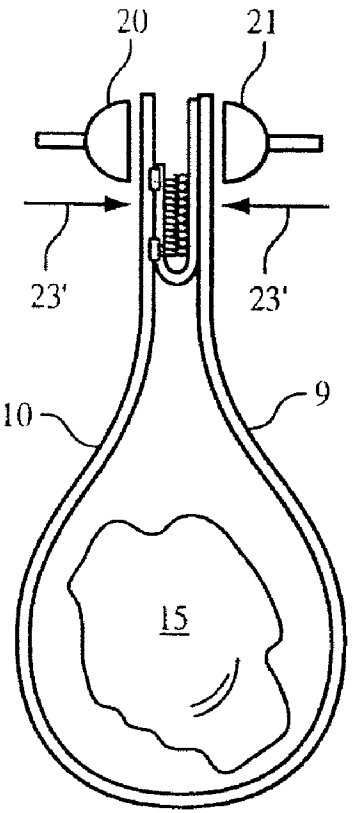
Figure 5E:
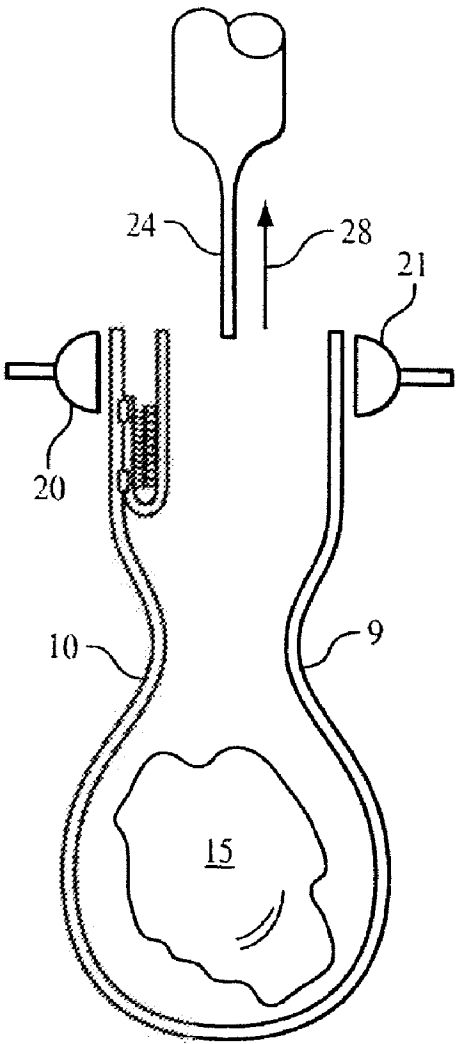

FIG. 5E shows the duckbill-filling funnel retracting along path 28 from the filled bag or pouch. The suction cups still engage the bag sides 9 and 10 holding them apart. Filling is complete.

FIG. 5F shows the suction cups closing along path 23' to close the top of the bag. FIG. 5G shows the bag closed. This corresponds to the condition shown in FIGS. 3A and 3B, the product 15 having entered the bag past the closure. The open end of the bag is now closed and ready for the seal to be formed at the top of the bag (see FIGS. 3B and 6).

Figure 6:
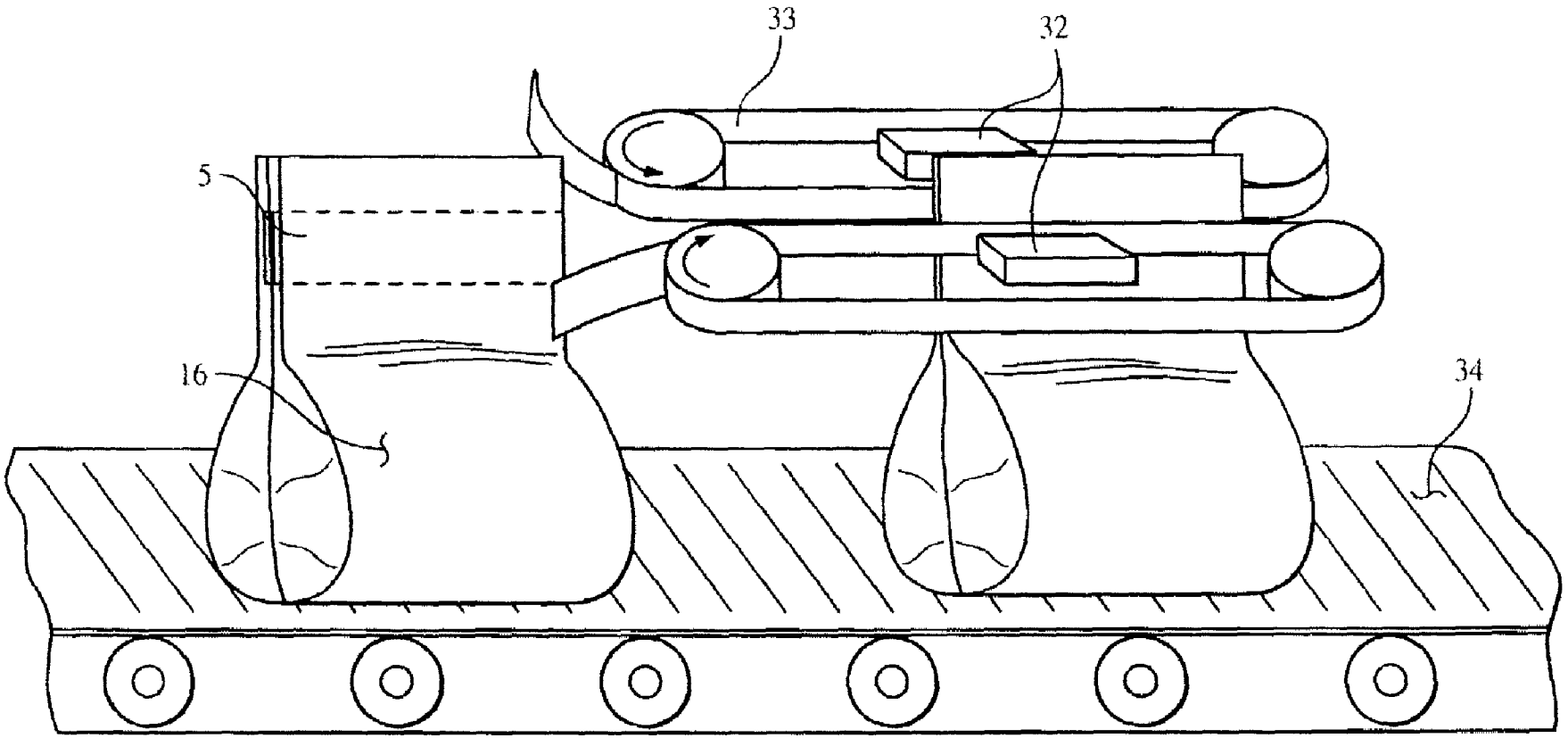
FIG. 6 is a perspective view of a conveyer and sealing system for applying a final weld to a burst closure on a filled bag.

FIG. 6 illustrates a downstream process, following the sequence described above. FIG. 6 shows the bag on a traveling conveyer 34, which brings the top of the filled bag between typically a pair of vertically oriented conveyer belts 33. Such belts are known as weld-compression belts. They grip and close the two halves of the top of the bag, compressing them uniformly together. At station 32, heat-seal jaws act against the captured film to effect the final thermal seal 8. Various welding arrangements can be employed. Weld jaws 32 can easily be drag-seal jaws or intermittent-motion jaws. The conveyer 34 may run continuously to effect drag-sealing through the station 32, or the conveyer 34 can stop at appropriate times to allow reciprocating heat-seal jaws 32 to come in, dwell to form the heat seal, and retract, following which, after further pausing for cooling and solidification of the heat-seal weld, conveyer 34 starts again to carry the sealed bag away and introduce another one.

The seal area 9*a* for this final seal 8 is as shown in FIG. 3A. The bag featured in FIG. 3A is without a handle. The final weld area 44 of the closure extends above the initial weld 6, providing ample clearance to effect weld 8 without the use of an insulating bar shown in FIG. 3B.

Referring again to FIG. 3B, this cross-sectional view shows the insulator bar 36 extending down into the filled bag to insulate the bag film 10 against being welded to the back side of flange 44 as the final weld for the burst seal. For FIG. 3B, weld bar 38 can come in and effect the final weld 8 of the package, either intermittently or by use of a drag seal. If intermittent, the bag stops, a weld bar 38 comes in, presses against the insulator bar 36 and seals or fuses the weld flange 44 of the closure to the weld area 9*a* of the bag. If a drag seal is employed, the conveyer supporting the bag does not stop, and the seal bar acts with constant pressure against seal area 8 and effectively seals by pressure and movement.

Figure 7:
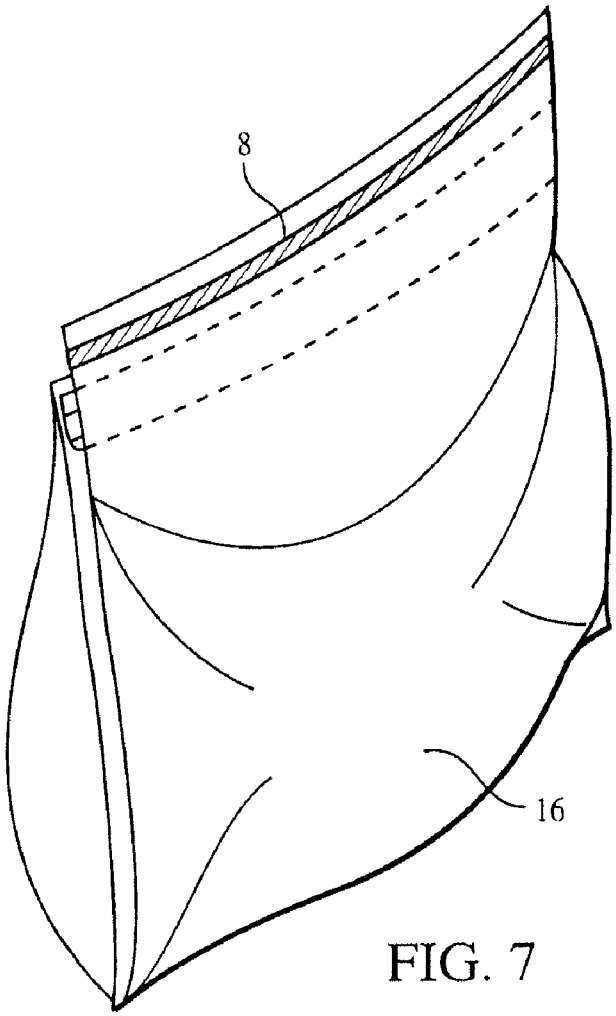
Figure 7A:
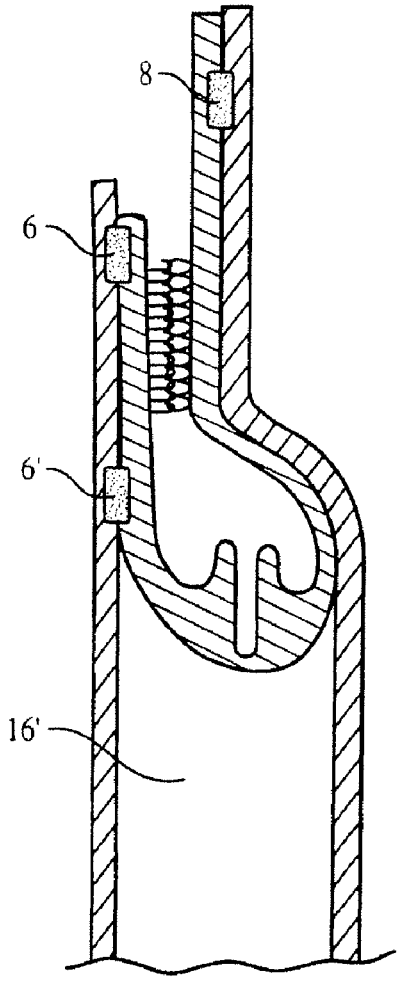
FIG. 7A is a magnified side cross-sectional view of the closure portion of the bag of FIG. 7.
Figure 7B:
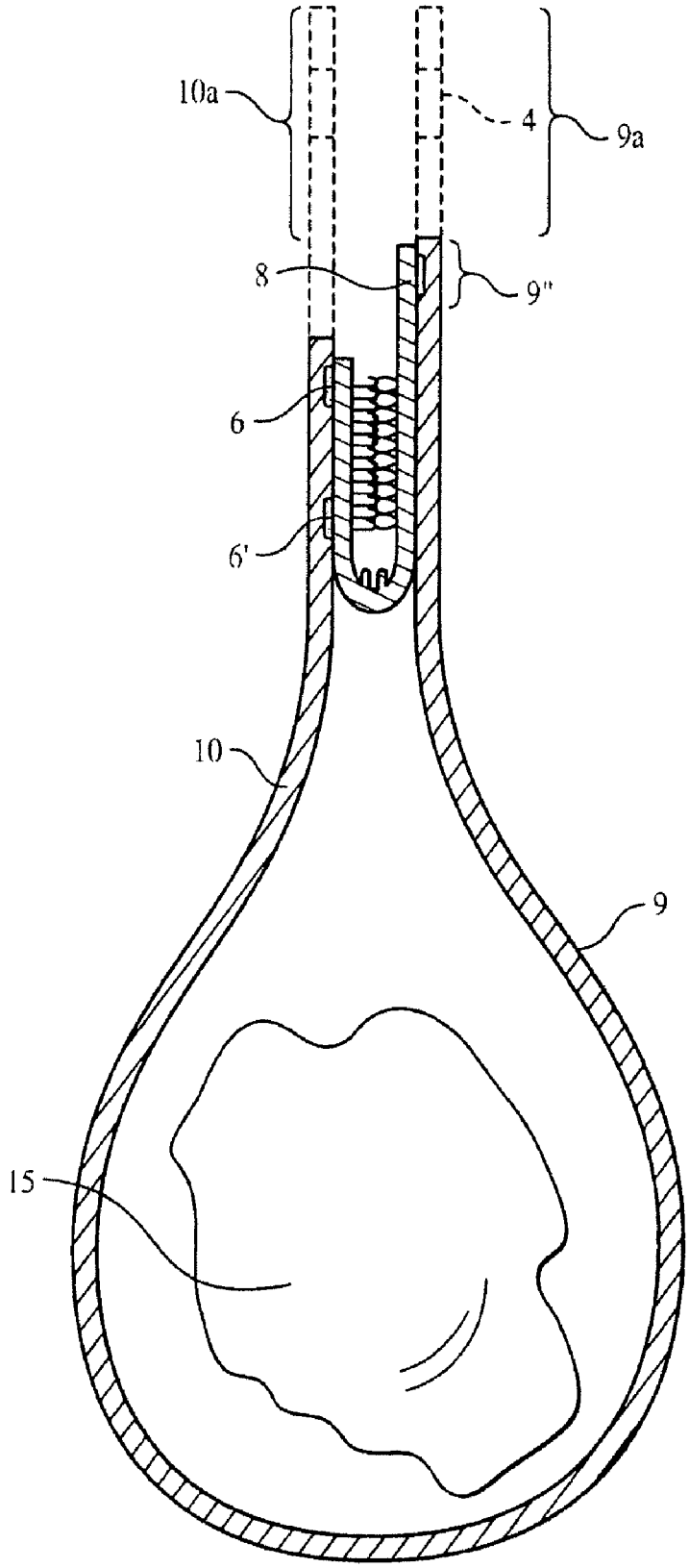
FIG. 7B is a side cross-sectional view on reduced scale of the entire product.

FIGS. 7, 7A and 7B show a filled sealed bag with the final seal 8 having been completed. FIG. 7 does not show the optional handle, a construction which can readily be made without the insulator bar 36. In FIG. 7B, a sectional view of a filled bag with product 15, handle 4 is shown in dashed lines above seal 8. In this case the insulator bar is positioned between the upper extensions 9*a* and 10*a*, on the back side of seal 8, as the seal is formed.

In certain preferred embodiments, the side seals 1 extend to the full top of the bag to ensure the sides of the package are sealed airtight. In this case, intermittent motions are employed to introduce the insulator between the side seals to form the final weld 8. In another case, e.g., where airtight sealing is not required, by accurately controlling the extent of the side welds 1 to stop, e.g., at the top edge of the hook and loop closure sections, a drag-sealing arrangement may be employed, in which the insulator slides between the sides of the handles, in the region of the final-weld flange.

Figure 8A:
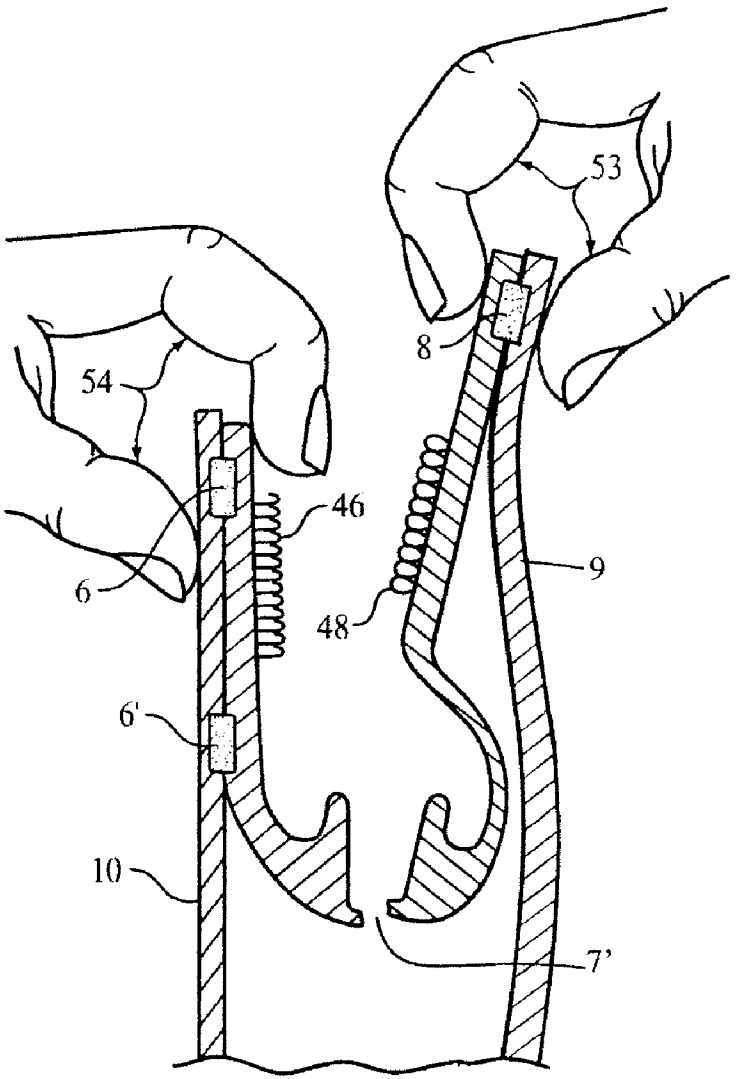
FIG. 8A illustrates a user opening the package by breaking a burst-seal feature of the closure.

FIG. 8 again shows a cross-section of the top edge of the bag and closure assembly showing the final weld 8. The burst feature 7 is shown unbroken. In FIG. 8A, the end user is shown breaking this burst membrane feature 7. Fingers 53, 54 of the right and left hands of the user are shown. The user grasps the region of the final seal 8 and the top seal 6. The user pulls these portions apart, thereby applying tensile force on thin section t' of the burst feature 7 of the closure (see also FIG. 4A). As shown in FIG. 8A, the tension ruptures the closure at 7', and entry is gained to the bag. Reclosing the bag or pouch is a simple matter of pressing the hook section 41 against the loop section 48. The antipeel flap, as mentioned in the disclosures of the below-referenced patent applications, is provided to provide a hinge flap on the side of the loop section 48. Product can then flow behind the loop section. The product force is thus applied to the weld 8 and the mated hook and loop closure is subjected substantially only to sheer forces (to which the closure is particularly resistant).

Figure 8:
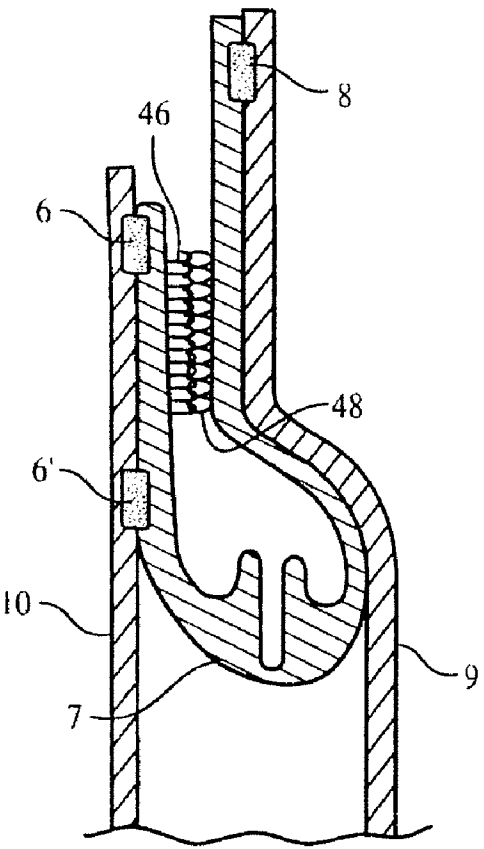

In an alternative to FIGS. 8 and 8A, in which the bag is provided with a pair of handles 4 in upper extensions of front and back walls 9, 10, fingers of the user's right and left hands are inserted in the handles, and the handles are pulled oppositely to effect the same rupture 7'.

Figure 9:
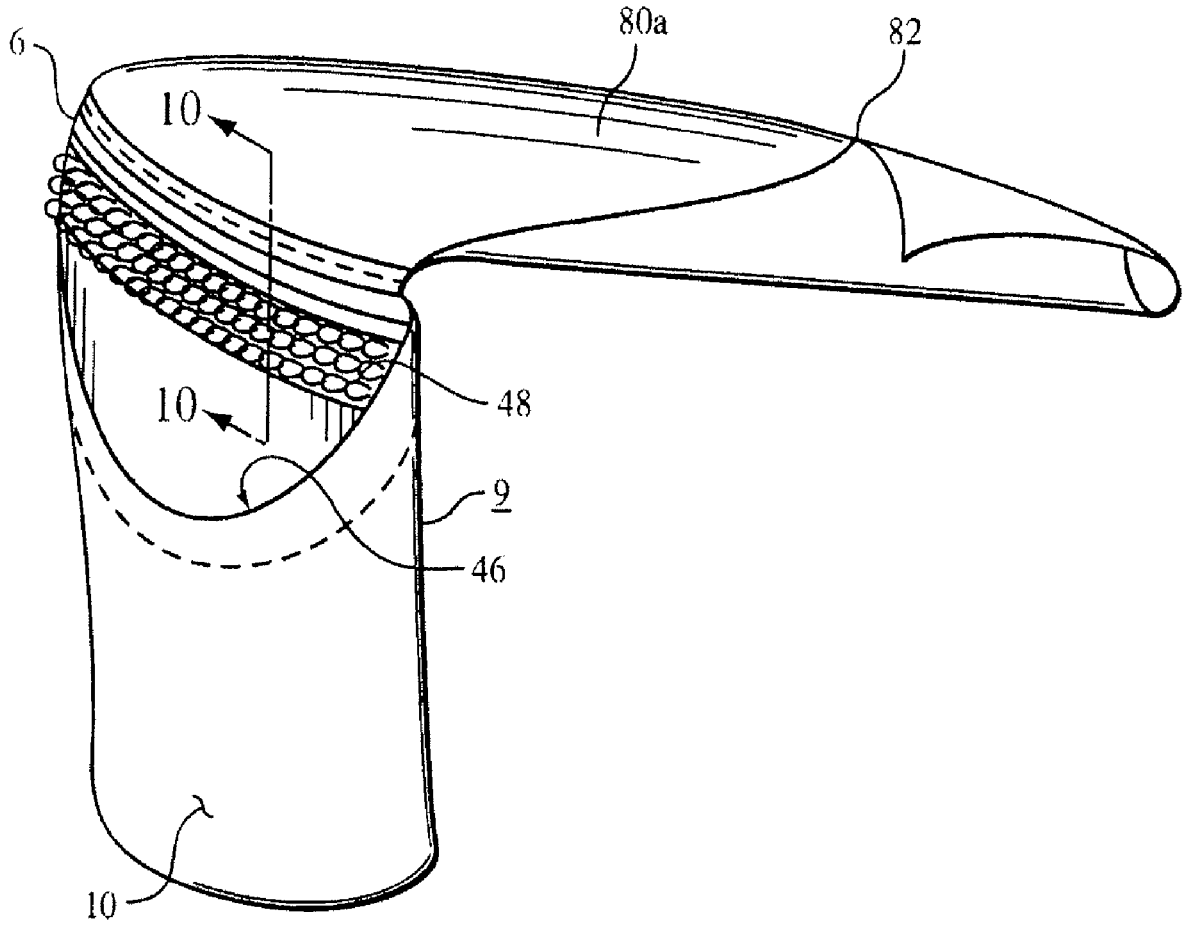
FIG. 9 is a perspective view of a bag having a fitment funnel attached to its top.
Figure 10:
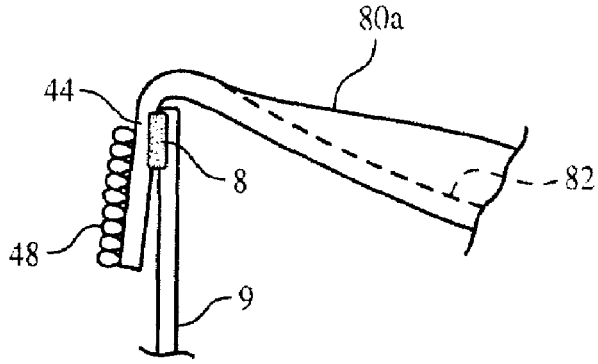
FIGS. 10 through 12 are alternative cross-sectional views, taken along line 10-10 of FIG. 9.
Figure 11:
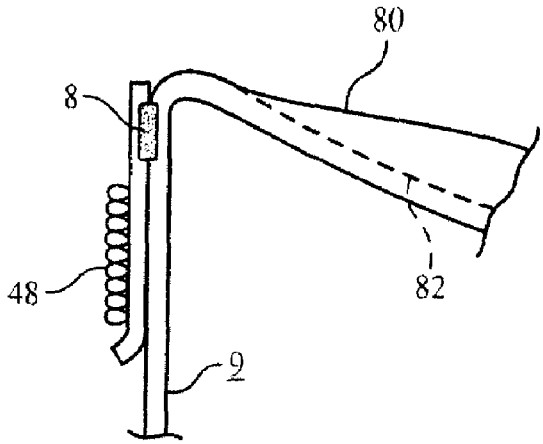
Figure 12:
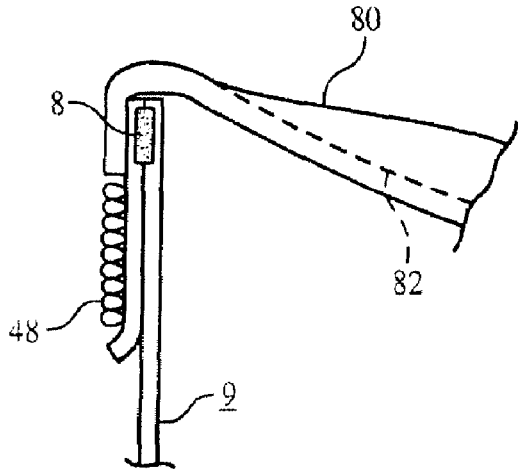

In FIG. 9 a funnel fitment 80 is shown on a bag. It may be formed in a number of advantageous ways. For example, in FIG. 10 an integral extension 80*a* of the resin base of the closure unit provides additional material from which funnel 80 is formed after formation of weld 8, by rolling the sides of the extension 80*a* together and forming a weld or adhesive joint 82 between them. In FIG. 11, on the other hand, the bag material is selected to be suitable for forming a funnel 80*b*, and an appropriately cut extension of the bag material itself constitutes a preform from which the funnel is formed. As shown in FIG. 12, in another embodiment funnel 80*b* is formed of a discrete preform sheet and bonded directly to the weld flange 44.

Thus, there has been described a closure that is suitable to be applied to a preformed pouch or preformed bag, which holds itself away from a fill path, keeping itself clean, and presenting an extended flange, which provides an effective target area for forming a final seal after the package has been filled. The bag, when opened, retains a self-seal feature. The closure requires no tools or special features to allow the end user to break open the bag while providing a secure shelf seal during shipment and store presentation. Applications to bags of dry granular product, upwards of 20- to 30-lb. (9 to 13.5 kilogram) bags, would be appropriate for this closure, as an example.

Either one or both walls of the bag may be extended upwardly to form either a handle on one face of the package or two handles as shown, one on each face of the package. Likewise, top extensions of one or both walls of the bag may define hanger holes for pegboard display of the product or fitment-landing regions for application of filler necks or tubes. The extended portions may also be the landing regions for header cards such as a chipboard to be stapled or affixed to the region. None of these interfere with the burst membrane of the closure.

The filling and sealing techniques that have been described may be useful for other types of closure besides hook and loop closures.

As one example, an anti-peel closure may be provided with the heat seals 6, 6' and 8 as described, that do not include a burst membrane, e.g., the two closure sections may be separate but mated. In this case, one can still have the benefit of a fill path presented effectively, because the hook and loop sections engage to hold the closure away from the fill path. The seal 8 can still be effected by the extended flange 44, accomplished in the same manner as previously described. Only slightly different tooling would be required to form welds 6 and 6' and then to mate the other closure section to it. In such a case, where the burst-seal feature 7 is omitted, the shelf seal can be, for instance, either a peel seal located below the hook and loop closure or a thermal seal above the hook and loop closure, that is cut or torn off to open the bag. A peel seal is typically a thermal seal which employs the same pulling motion as the burst seal to peel it apart. It fails, for instance, based on the limited cohesiveness of additives of the wall portion that allow separation. It typically is not tacky after opening. The user peels through it, hence the name "peel seal," an action which exposes the hook and loop closure, which would then be opened to gain access to the bag.

The thermal seal mentioned would be a permanent seal, which would be cut or torn off of the bag and therefore would only be placed on the bags above the hook and loop closure.

It will be understood that the regions devoted respectively to the hook and loop sections, in the embodiments shown, can be reversed, and various types of specific closure materials and fastener elements can be employed to produce hook and loop engagement.

As evident from the embodiments described above, the closure strip is useful in many packaging applications, for providing a readily-engaged releasable closure that does not require perfect alignment during closing. The closure is useful for packaged food items, such as grains, meals, animal food, dog food, litter, sugar, flour, cookies, candy bars, and even produce, and may be located at one sealed end or along a longitudinal seam of the package. By "bag", we mean to include all packages with flexible sides, including but not limited to standable pouches and flexible cartons.

The contents of the following applications are all incorporated herein by reference as if fully set forth: U.S. patent applications Ser. No. 09/187,389, filed Nov. 6, 1998, Ser. No. 09/293,257 filed Apr. 16, 1999, Ser. No. 60/240,288 filed Oct. 13, 2000, PCT/US01/31689, filed Oct. 11, 2001 and WO US99/26261 filed Nov. 5, 1997, designating the United States among others.

Other embodiments will be understood to fall within the scope of the following claims.

What is claimed is:

1. A method of filling a bag, the method comprising:

providing a partially constructed bag comprising a first bag wall;

a second bag wall opposite the first bag wall; and a closure strip comprising a first side wall and a second side wall, an outer surface of the first side wall being affached to an inner surface of the first bag wall, the first side wall of the closure strip comprising one of a hook component and a loop component and the second side wall of the closure strip comprising the other of the hook component and the loop component, the closure strip being folded in a frangible region such that the hook and loop components are engaged with one another;

holding the partially constructed bag open to define a fill path extending between the second side wall of the closure strip and the second bag wall;

inserting an insulator between the first and second side walls of the closure strip; and joining an outer surface of the second side wall of the closure strip to an inner surface of the second bag wall in a region of the second side wall behind which the insulator is positioned.

2. The method of claim 1, wherein joining the outer surface of the second side wall of the closure strip to the inner surface of the second bag wall comprises heat sealing the outer surface of the second side wall of the closure strip to the inner surface of the second bag wall.

3. The method of claim 2, wherein the insulator is constructed to prevent the first and second side walls of the closure strip from being sealed together while heat sealing the outer surface of the second side wall of the closure strip to the inner surface of the second bag wall.

4. The method of claim 1, wherein the first and second side walls of the closure strip are spaced apart from one another at an upper region of the closure strip, allowing the insulator to be inserted therebetween.

5. The method of claim 1, further comprising pouring contents into the open partially constructed bag through the fill path.

6. The method of claim 5, wherein the outer surface of the second side wall of the closure strip is joined to the inner surface of the second bag wall after pouring contents into the open partially constructed bag.

7. The method of claim 1, wherein the second bag wall extends beyond the bag opening to form an extension.

8. The method of claim 7, wherein the extension of the second bag wall defines a handle.

9. The method of claim 1, wherein the insulator comprises an insulator bar.

10. The method of claim 1, wherein the second side wall of the closure strip extends beyond the first side wall of the closure strip.

11. A method of filling a bag, the method comprising:

providing a partially constructed bag comprising a first bag wall;

a second bag wall opposite the first bag wall; and a closure strip comprising a first side wall and a second side wall that extends beyond the first side wall, an outer surface of the first side wall being affached to an inner surface of the first bag wall, the first side wall of the closure strip comprising one of a hook component and a loop component and the second side wall of the closure strip comprising the other of the hook component and the loop component, the closure strip being folded in a frangible region such that the hook and loop components are engaged with one another;

holding the partially constructed bag open to define a fill path extending between the second side wall of the closure strip and the second bag wall;

inserting an insulator between the first bag wall and a portion of the second side wall that extends beyond the first side wall; and joining an outer surface of the second side wall of the closure strip to an inner surface of the second bag wall in a region of the second side wall behind which the insulator is positioned.

12. The method of claim 11, wherein joining the outer surface of the second side wall of the closure strip to the inner surface of the second bag wall comprises heat sealing the outer surface of the second side wall of the closure strip to the inner surface of the second bag wall.

13. The method of claim 12, wherein the insulator is constructed to prevent the first bag wall and the second side wall of the closure strip from being sealed together while heat sealing the outer surface of the second side wall of the closure strip to the inner surface of the second bag wall.

14. The method of claim 11, further comprising pouring contents into the open partially constructed bag through the fill path.

15. The method of claim 14, wherein the outer surface of the second side wall of the closure strip is joined to the inner surface of the second bag wall after pouring contents into the open partially constructed bag.

16. The method of claim 11, wherein the insulator comprises an insulator bar.

* * * * *

UNITED STATES PATENT AND TRADEMARK OFFICE

CERTIFICATE OF CORRECTION

PATENT NO. : 7,424,796 B2
APPLICATION NO. : 11/927261
DATED : September 16, 2008
INVENTOR(S) : William H. Shepard et al.

It is certified that error appears in the above-identified patent and that said Letters Patent is hereby corrected as shown below:

Claim 1, column 13, line 8:
delete "affached" and replace with --attached--.

Claim 11, column 14, line 12:
delete "affached" and replace with --attached--.

Signed and Sealed this

Eighteenth Day of November, 2008

JON W. DUDAS
*Director of the United States Patent and Trademark Office*